US012215504B2

(12) United States Patent
Bilge et al.

(10) Patent No.: US 12,215,504 B2
(45) Date of Patent: Feb. 4, 2025

(54) SYSTEM AND METHOD OF INSTALLING FACADE PANELS

(71) Applicant: TREMCO CPG INC., Beachwood, OH (US)

(72) Inventors: Henry H. Bilge, Fort Lee, NJ (US); Wendy Ann Pole, Burlington (CA); Viktor Drobyshevskiy, Monroe Township, NJ (US); Steven Douglas Mort, Cleveland Heights, OH (US); John Richard Bunting, Nashville, TN (US)

(73) Assignee: TREMCO CPG INC., Beachwood, OH (US)

( * ) Notice: Subject to any disclaimer, the term of this patent is extended or adjusted under 35 U.S.C. 154(b) by 171 days.

(21) Appl. No.: 17/682,616

(22) Filed: Feb. 28, 2022

(65) Prior Publication Data

US 2022/0275651 A1 Sep. 1, 2022

Related U.S. Application Data

(60) Provisional application No. 63/154,801, filed on Feb. 28, 2021.

(51) Int. Cl.
*E04F 13/08* (2006.01)

(52) U.S. Cl.
CPC ..... *E04F 13/0803* (2013.01)

(58) Field of Classification Search
CPC ... E04F 3/0803; E04F 13/083; E04F 13/0805; E04F 13/0816; E04F 13/0819;
(Continued)

(56) References Cited

U.S. PATENT DOCUMENTS 3,117,353 A * 1/1964 Edwards ..... E04F 13/0835 403/403
4,194,333 A 3/1980 Paton et al.
(Continued)

FOREIGN PATENT DOCUMENTS

CH 627810 A5 * 1/1982
EP 0685614 A1 12/1995
(Continued)

OTHER PUBLICATIONS

International Preliminary Report on Patentability from PCT/US2022/018150 dated Sep. 14, 2023 (8 pages).
(Continued)

*Primary Examiner* — Theodore V Adamos
(74) *Attorney, Agent, or Firm* — Calfee, Halter & Griswold LLP

(57) ABSTRACT

A wall cladding system includes a slab bracket, a connector tube, first and second façade panels, and first and second attachment rails. The slab bracket includes a base wall and first and second forward extending flanges defining a gap in which the connector tube is secured. The first attachment rail is secured along an upper edge the first façade panel and includes a mounting wall fastened to the connector tube and a support wall extending upward from the mounting wall, spaced from the connector tube to define a first slot. The second attachment rail is secured along a lower edge of the second façade panel and includes a downward extending hanger wall spaced apart from a rear surface of the second façade panel to define a second slot, with the hanger wall received in the first slot and the support wall received in the second slot.

18 Claims, 32 Drawing Sheets

(58) Field of Classification Search
CPC ..... E04F 13/0808; E04B 2/88; E04B 2/885; E04B 2/96; E04B 2/965
See application file for complete search history.

(56) References Cited

U.S. PATENT DOCUMENTS

| | | | | |
|---|---|---|---|---|
| 6,000,178 | A * | 12/1999 | Goodings | E04F 19/06 52/235 |
| 7,043,884 | B2 | 5/2006 | Eurogramco et al. | |
| 7,096,629 | B1 * | 8/2006 | Cox | E04F 13/0814 52/489.1 |
| 8,826,620 | B2 | 9/2014 | Krause | |
| 9,267,280 | B2 | 2/2016 | Sawatzky et al. | |
| 9,518,386 | B2 | 12/2016 | Ehsasi | |
| 9,708,812 | B2 | 7/2017 | Jeske | |
| 10,081,953 | B2 | 9/2018 | Armacost et al. | |
| 2003/0150179 | A1 | 8/2003 | Moreno | |
| 2013/0174506 | A1 | 7/2013 | Bombino et al. | |
| 2013/0205695 | A1 * | 8/2013 | Newell | E04F 13/08 52/235 |
| 2016/0230793 | A1 * | 8/2016 | Gulnick | E04F 13/083 |

FOREIGN PATENT DOCUMENTS

| | | | | |
|---|---|---|---|---|
| EP | 0701896 | A1 | 3/1996 | |
| FR | 2972746 | A1 * | 9/2012 | E04F 13/0805 |
| KR | 837669 | B1 | 6/2008 | |
| KR | 20120073725 | A * | 7/2012 | |
| KR | 101611595 | B1 * | 4/2016 | |
| WO | 99/64692 | A1 | 12/1999 | |
| WO | 2009/059392 | A1 | 5/2009 | |

OTHER PUBLICATIONS

International Search Report and Written Opinion from PCT/US2022/018150 dated Jun. 2, 2022 (14 pages).

Alpha E Bracket—Edge To Edge, https://www.ecocladding.com/alpha-e-bracket-edge-edge, accessed Oct. 15, 2021 (8 pages).

Halfen Anchor Channels and HCW Brackets, Halfen HCW Curtain Wall Technical Product Information, 2014 (36 pages).

Vertical metal profiles fixed with helping hand brackets https://elzinc.es/en/architects-promoters/installation-systems/engineered-facades/designing-with-elzinc-enfineered-facades, accessed Oct. 15, 2021 (10 pages).

Curtain walls brackets—BSP Bracket System Polska, https://www.bspsystem.com/en/systemy/konsole-do-fasad-slupowo-ryglowych accessed Oct. 15, 2021 (3 pages).

Ventilated Stone Cladding System, https://wfmmedia.com/ventilated-stone-cladding-system, accessed Oct. 15, 2021 (14 pages).

* cited by examiner

SYSTEM AND METHOD OF INSTALLING FACADE PANELS

CROSS-REFERENCE TO RELATED APPLICATIONS

This application claims priority to and all benefit of U.S. Provisional Patent Application Ser. No. 63/154,801, filed on Feb. 28, 2021, entitled SYSTEM AND METHOD OF INSTALLING FAÇADE PANELS, the entire disclosure of which is incorporated herein by reference.

TECHNICAL FIELD

The present invention relates to a system of installing an exterior wall onto an existing building structure.

BACKGROUND

An exterior wall assembly of a building is typically comprised of façade or cladding panels, cladding attachment components, insulation, cladding support components which fasten using screws/anchors to the structure of the building. The exterior wall assembly carries two main functions. The first is to provide an aesthetically pleasing façade, and the second is to provide a barrier to the natural elements and controlling the interior climate for occupants.

The process of installing this wall assembly has historically been done in the field/on-site as a multi-step process which is both labor intensive and time consuming. Furthermore, historically, since each unit of a wall system is a separate component, quality varies based on individual installer. Separate units also demand elaborate weather proofing and sealing operations, where durability and quality is even harder to control and predict. As a result, developers and building owners have come to accept a relatively high failure rate and an ongoing patching effort in a fight to keep moisture and wind out of the seals.

In conventional applications, the installation of large panel and/or prefabricated façade panels and much of the attachment and support system can be assembled offsite and sections of completed wall are shipped to the job site. Manufacture and shipment are usually coordinated on a floor-by-floor basis due to the fact that sections of large panel or prefabricated wall systems are deployed and anchored independent of one another, with gaps above, below and on the sides of each panel. Each such joint between sections is then sealed with caulking, deployment of tape, etc.

Summary

The present disclosure contemplates systems and methods for installing a wall cladding system, for example, providing for rapid installation of exterior wall cladding panel components from an exterior of the building. In exemplary embodiments of the disclosed systems, the components interconnect the upper and lower ends of each wall panel above and below respectively, and may accommodate for adjustments in wall cladding irregularity, provide an interlocking, installation method for inserting multiple panels faster than other methods, and/or ensure plum and leveling in panel to panel connections.

In an exemplary embodiment of the present disclosure, a wall cladding system includes a slab bracket, a connector tube, first and second façade panels, and first and second attachment rails. The slab bracket includes a base wall and first and second forward extending flanges defining a gap in which the connector tube is secured. The first attachment rail is secured along an upper edge the first façade panel and includes a mounting wall fastened to the connector tube and a support wall extending upward from the mounting wall, spaced from the connector tube to define a first slot. The second attachment rail is secured along a lower edge of the second façade panel and includes a downward extending hanger wall spaced apart from a rear surface of the second façade panel to define a second slot, with the hanger wall received in the first slot and the support wall received in the second slot.

In another exemplary embodiment of the present disclosure, a method of installing a wall cladding system on a building structure is contemplated. In the exemplary method, a base wall of a slab bracket is mounted to a building structure, the slab bracket including first and second forward extending flanges defining a gap therebetween. A first façade panel is provided with a first attachment rail secured along an upper edge the first façade panel, and a connector tube fastened to a mounting wall of the first attachment rail, with a support wall of the first attachment rail extending upward from the mounting wall being spaced from the connector tube to define a first slot. A second façade panel is provided with a second attachment rail secured along a lower edge of the second façade panel, with a downward extending hanger wall of the second attachment rail being spaced apart from a rear surface of the second façade panel to define a second slot. The connector tube is secured in the gap using one or more fasteners secured through first and second side walls of the connector tube and through the first and second forward extending flanges. The hanger wall of the second attachment rail is inserted in the first slot and the support wall of the first attachment rail in the second slot for interlocking retention of the second attachment rail and second façade panel with the first façade panel.

BRIEF DESCRIPTION OF THE DRAWINGS

Further features and advantages of the invention will become apparent from the following detailed description made with reference to the accompanying drawings, wherein.

DETAILED DESCRIPTION

Figure 1:
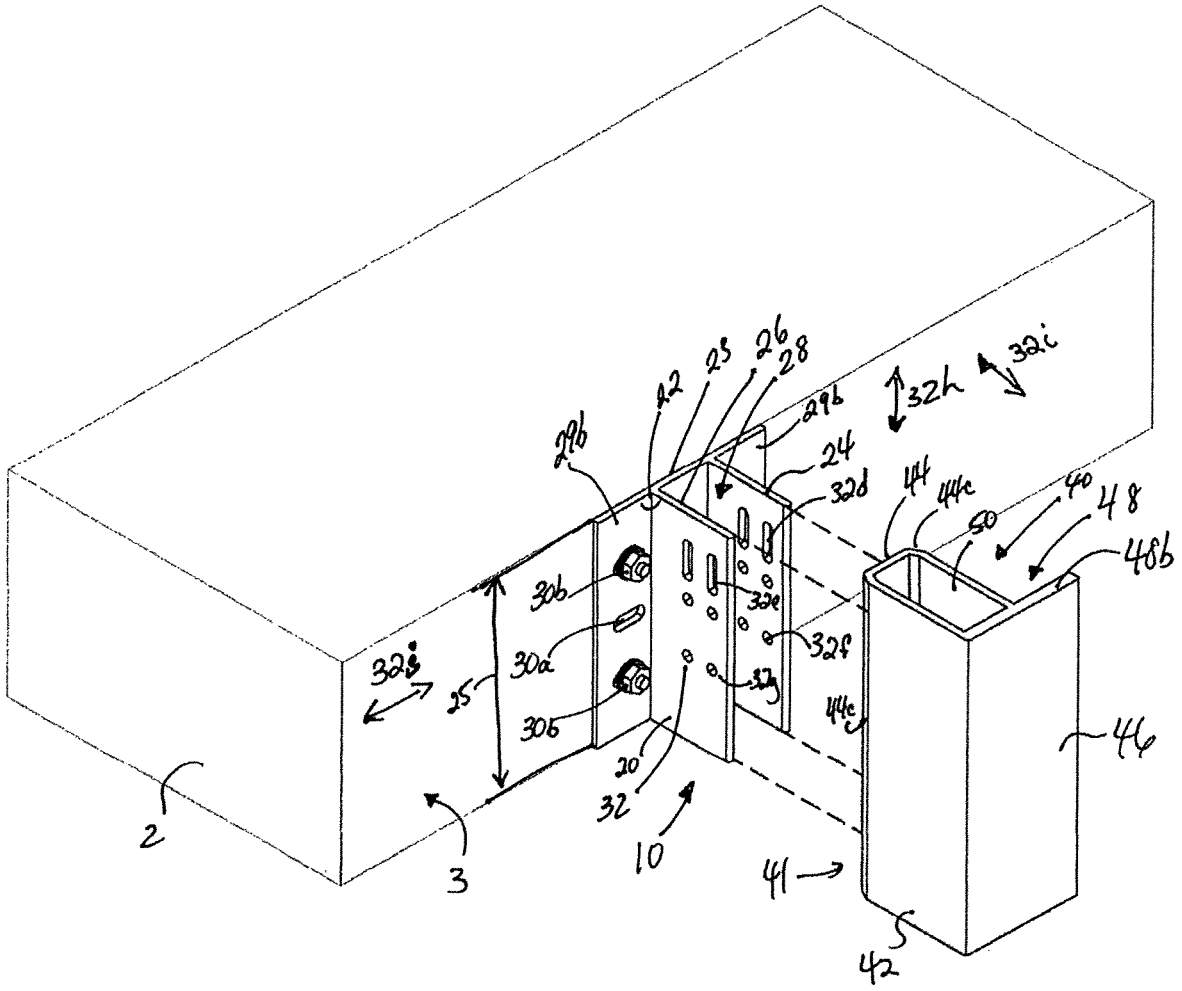
FIG. 1 illustrates a perspective view of a slab bracket and connector tube for an anchoring system, shown with the slab bracket secured to a building slab, in accordance with an exemplary embodiment of the present disclosure.

This Detailed Description merely describes exemplary embodiments and is not intended to limit the scope of the claims in any way. Indeed, the invention as claimed is broader than and unlimited by the described embodiments, and the terms used have their full ordinary meaning.

Exemplary embodiments of the present disclosure will now be described with reference to the drawings. Such embodiments are provided by way of explanation of the present inventions, which are not intended to be limited thereto. In fact, those of ordinary skill in the art may appreciate upon reading the present specification and viewing the present drawings that various modifications and variations can be made thereto.

According to an exemplary aspect of the present disclosure, an anchor system for securely mounting two or more façade panels to a building structure (e.g., vertically spaced floor slabs and/or one or more vertically extending building wall substrates) may include a slab bracket mountable to the building structure. A first attachment rail is secured along an upper edge of a first, lower façade panel, and a connector tube is fastened to a mounting wall of the first attachment rail, with a support wall of the first attachment rail extending upward from the mounting wall, spaced from the connector tube to define a first slot. A connector tube is secured in a channel defined by first and second forward extending flanges of the slab bracket. A second attachment rail is secured along a lower edge of a second, upper façade panel, and includes a downward extending hanger wall spaced apart from the rear surface of the second façade panel to define a second slot. After securing the connector tube in a channel or gap defined by the slab bracket, the hanger wall of the second attachment rail is inserted into the first slot, and the support wall of the first attachment rail is received in the second slot, for interlocking retention of the second attachment rail and second façade panel with the mounted first façade panel. The upper end of the second façade panel may be mounted to the building structure using a similar anchor system arrangement, which may provide for similar interlocking attachment of a third façade panel above the second façade panel.

The anchoring systems and wall cladding systems described herein may provide several advantages. As one example, the interlocking rail attachment to the façade panels and to the bracket and connector tube anchor mount may provide for blind installation of the upper façade panel over the mounted lower façade panel, for ease of installation. As another example, the anchor system may provide for use of relatively short connector tubes that do not extend or span between panel mounting locations, and may, for example, be similar in vertical length to the slab bracket. Such discrete mounting locations may be made possible by use with structurally reinforced façade panels, examples of which are described in co-pending U.S. application Ser. No. 17/528,361, filed on Nov. 17, 2021 and entitled STRUCTURAL INSULATED FINISHED CLADDING ASSEMBLIES (the "'361 Application"), the entire disclosure of which is incorporated herein by reference.

Figure 9:
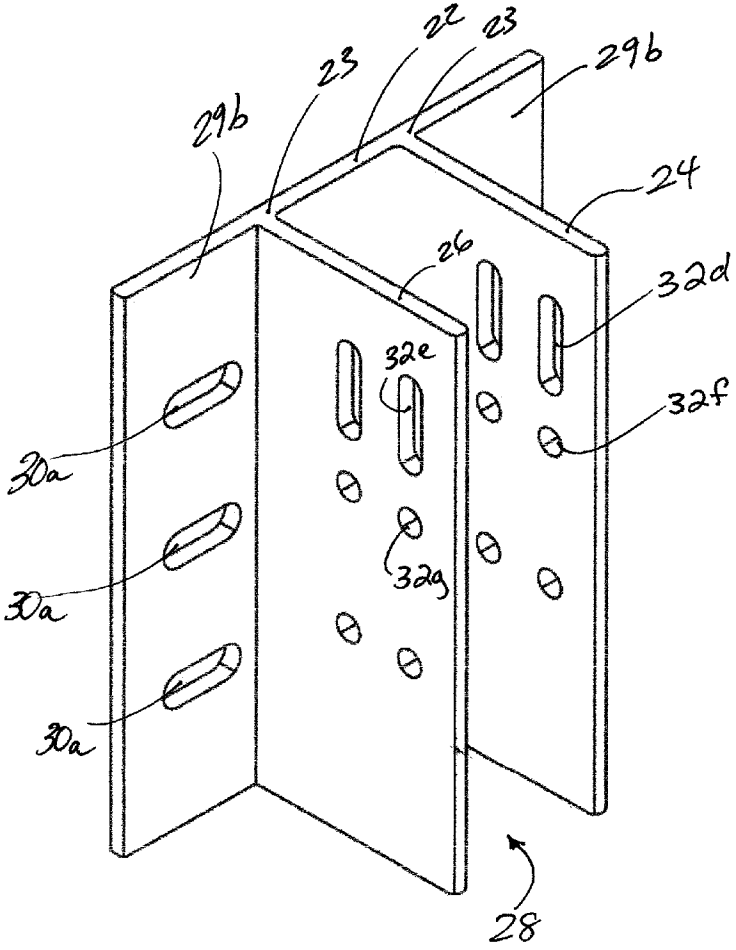
FIGS. 9 and 10 illustrates front perspective and rear perspective views of the slab bracket of FIG. 1.
Figure 10:
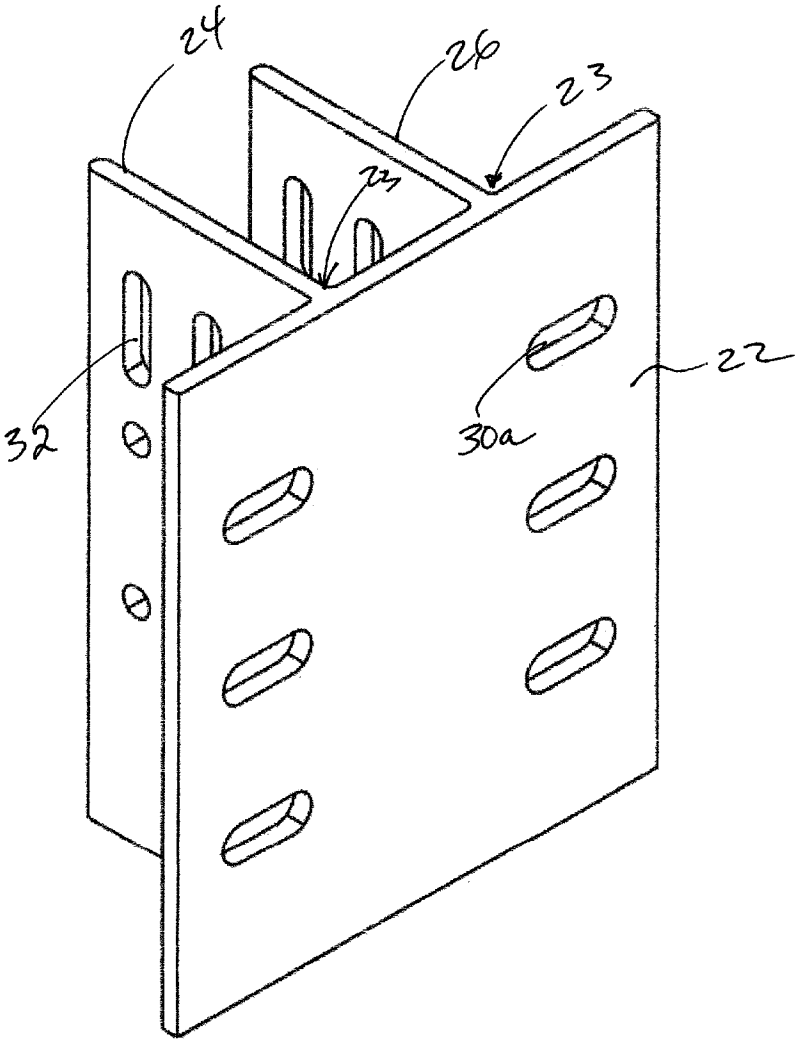
Figure 11A:
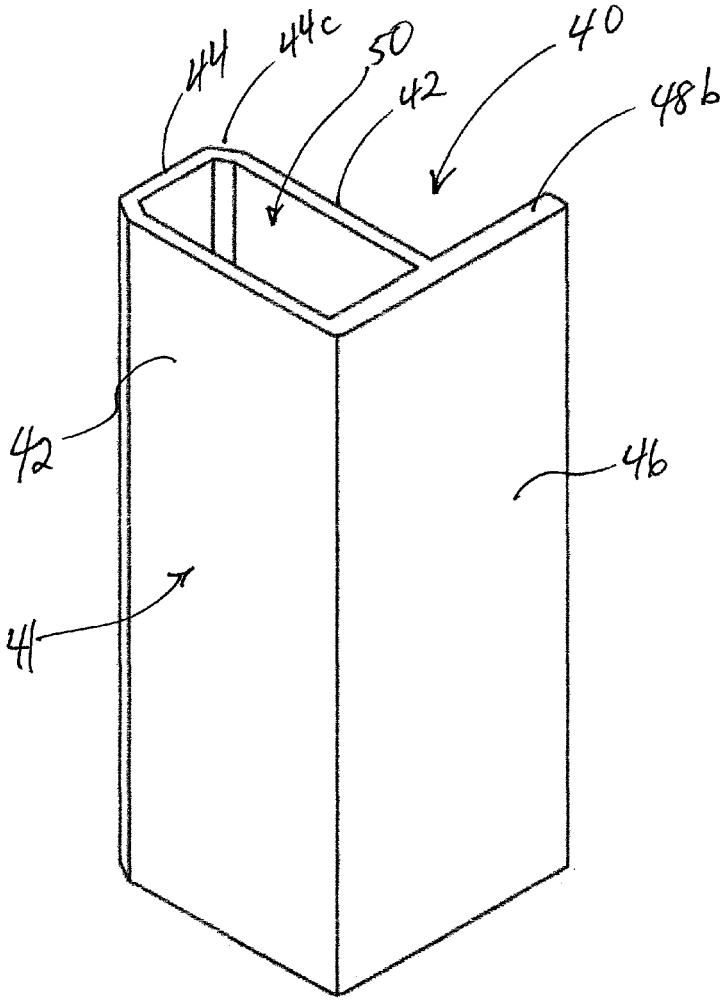
FIGS. 11A through 11F illustrates perspective, front elevational, rear elevational, top plan, left side elevational, and right side elevational views of the connector tube of FIG. 1.
Figure 11B:
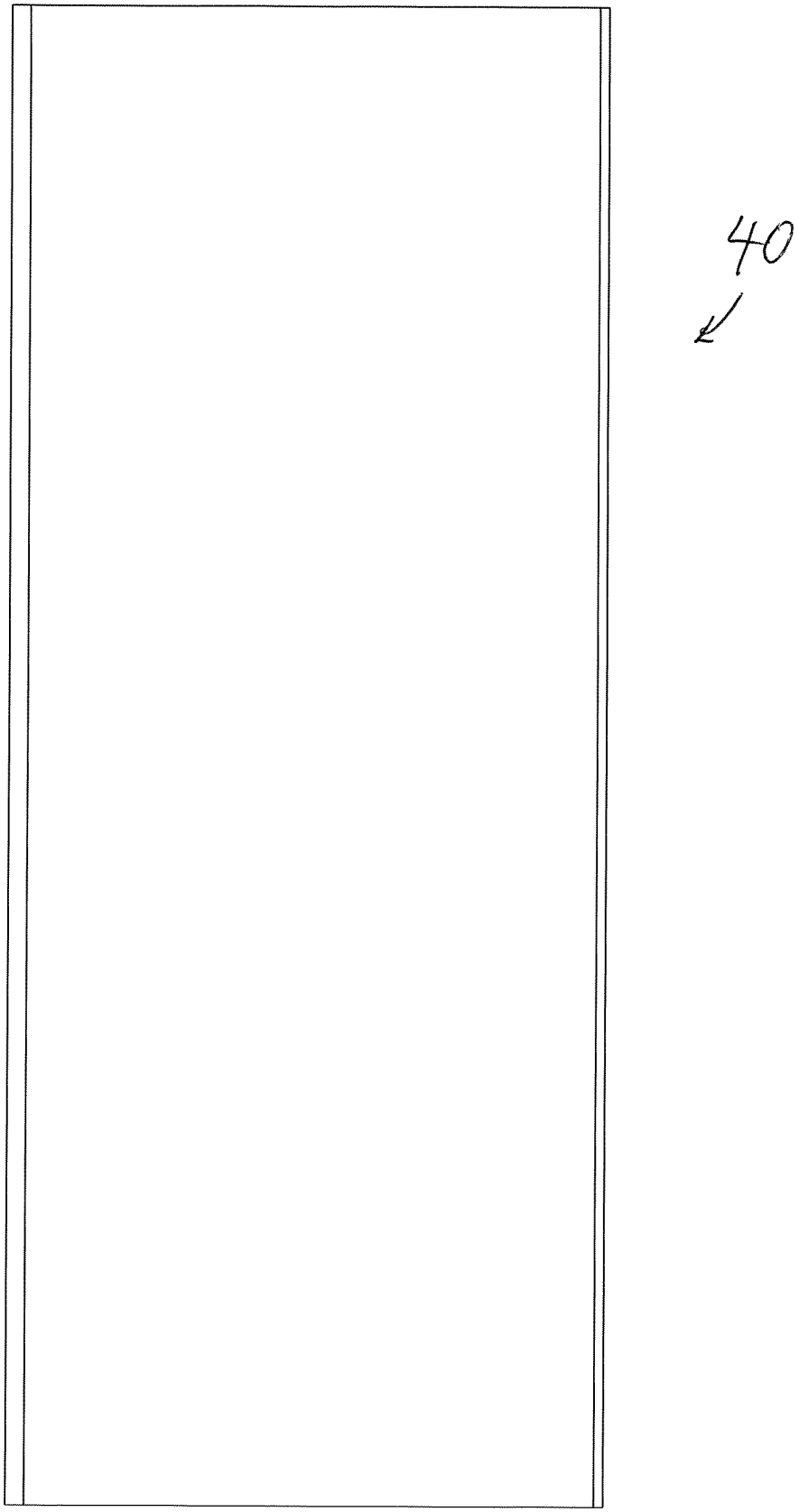
Figure 11C:
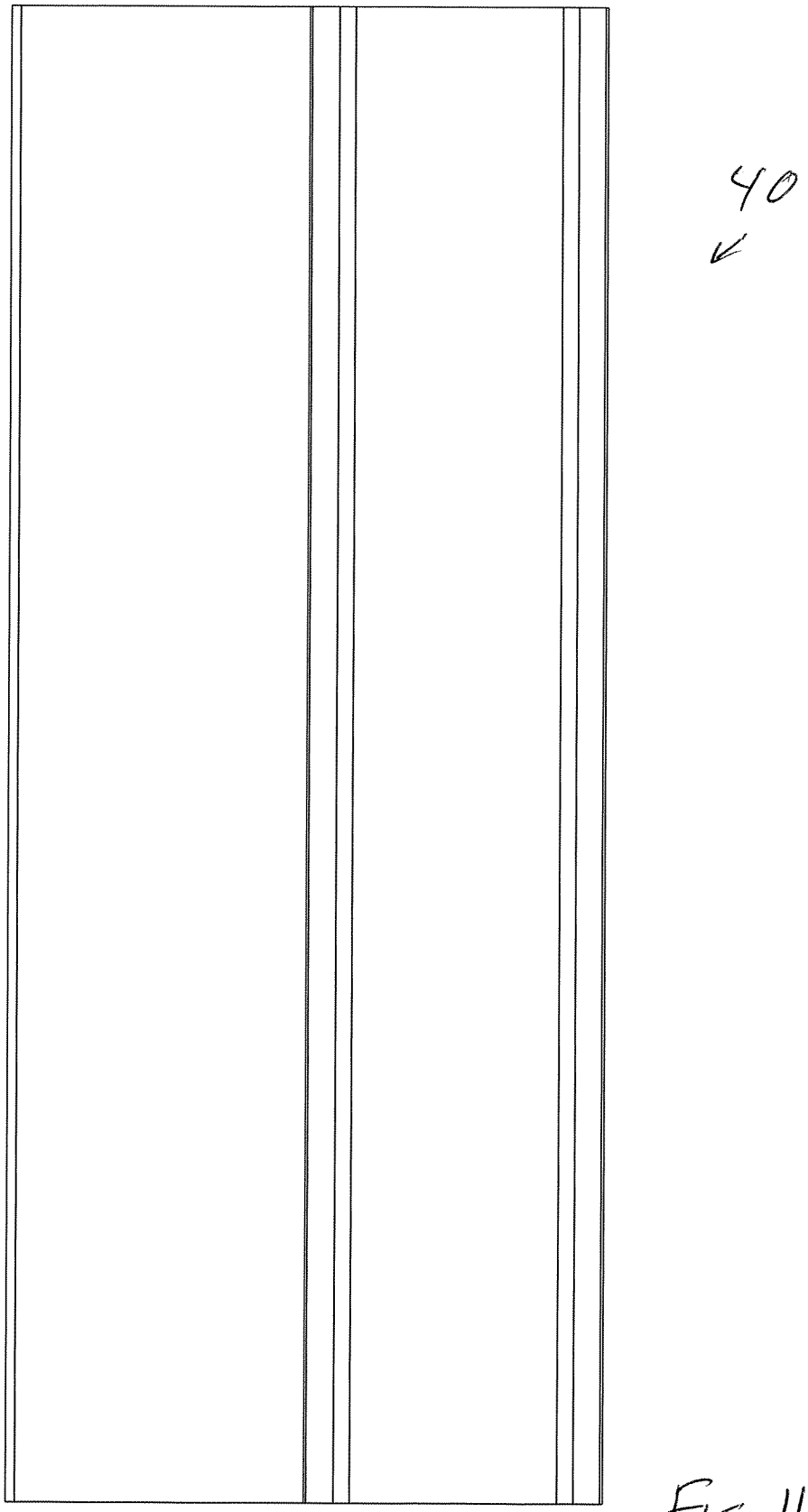
Figure 11D:
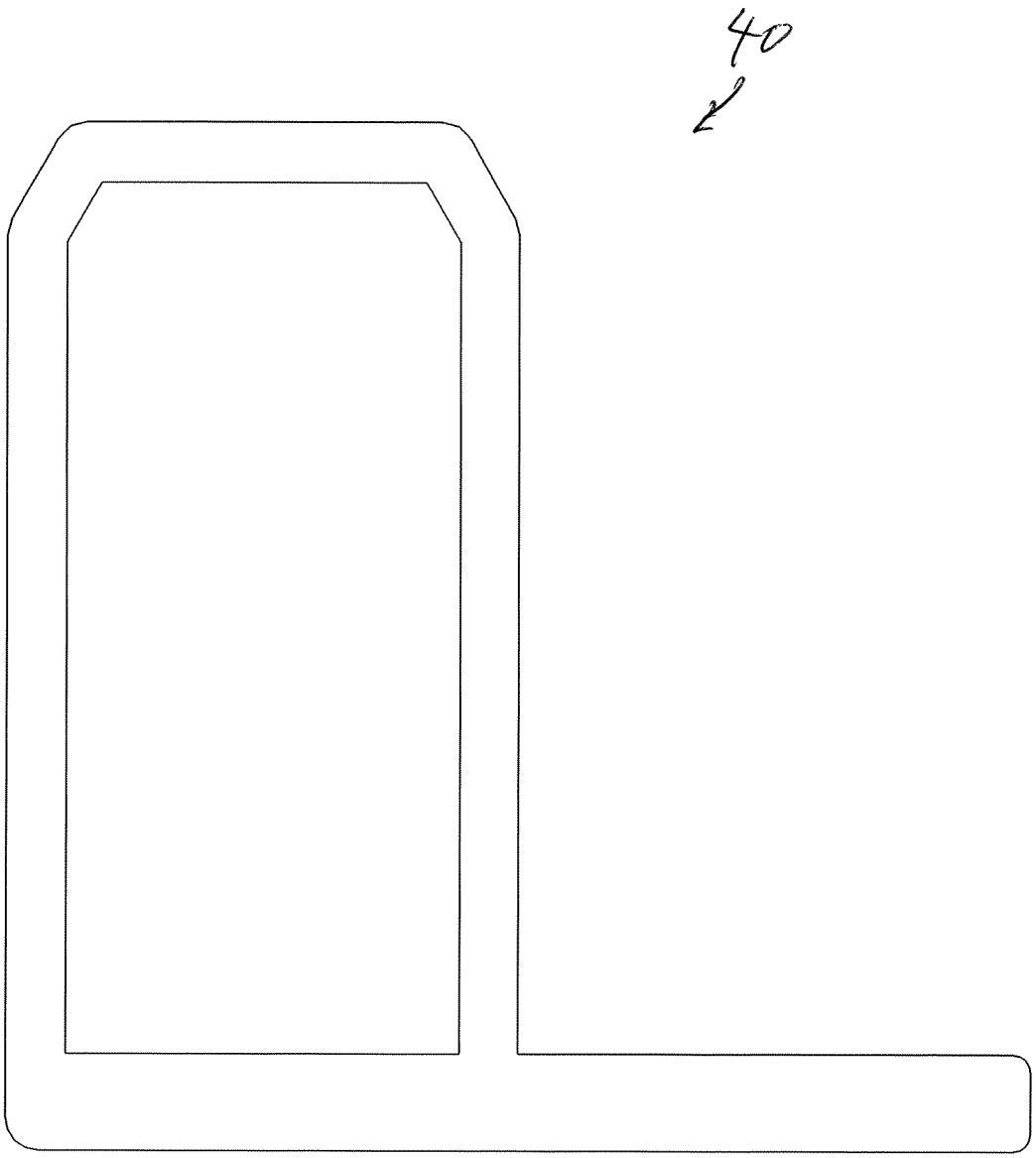
Figure 11E:
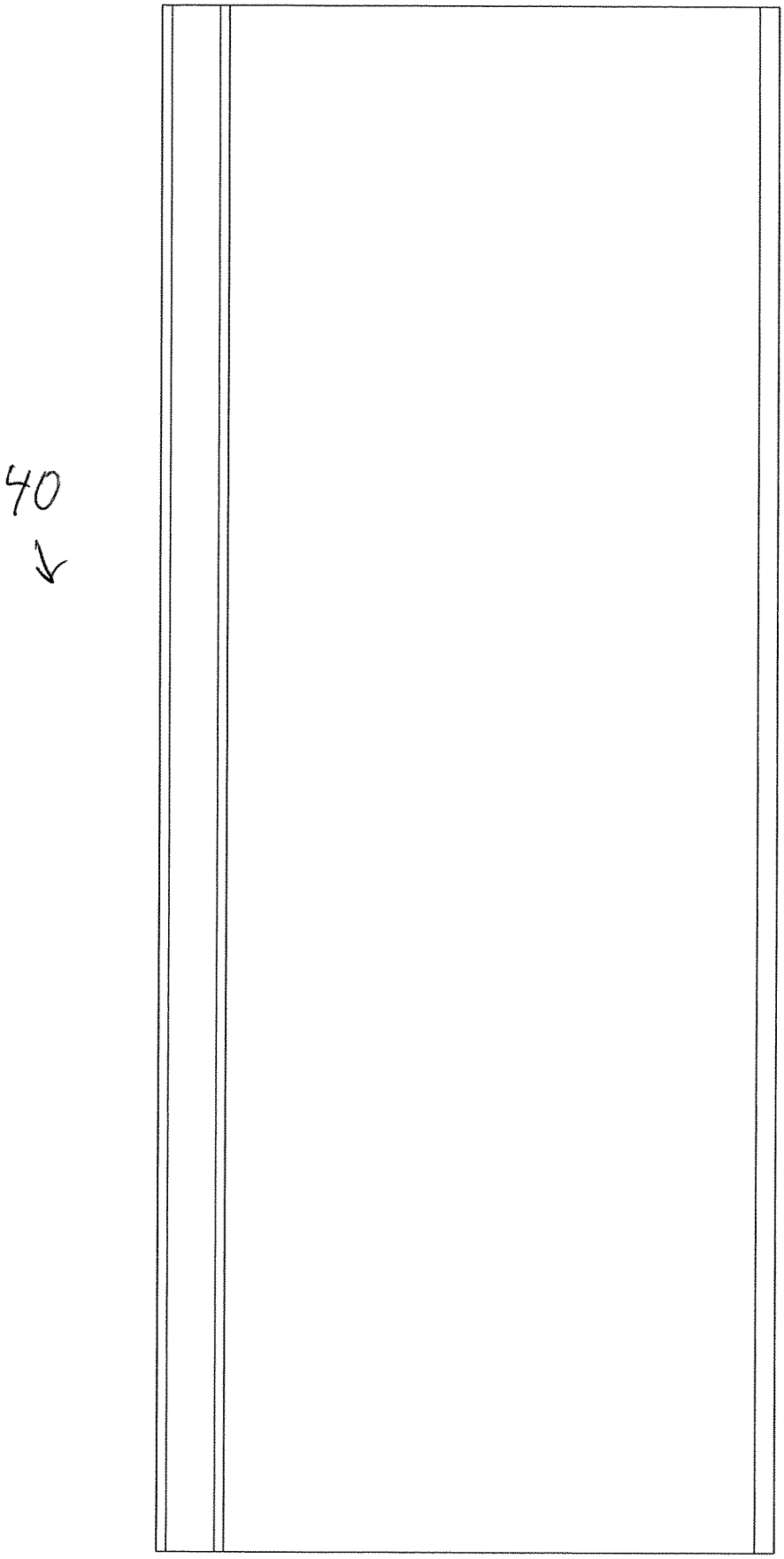
Figure 11F:
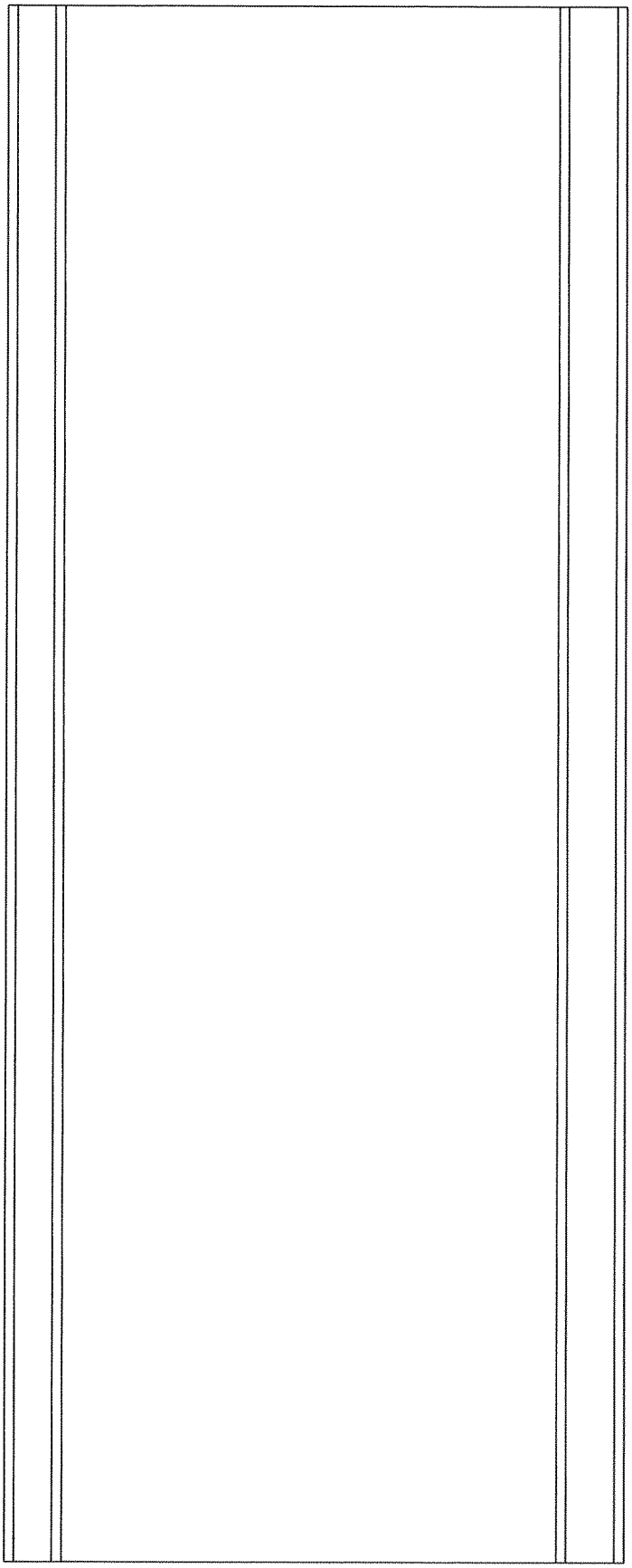
Figure 12A:
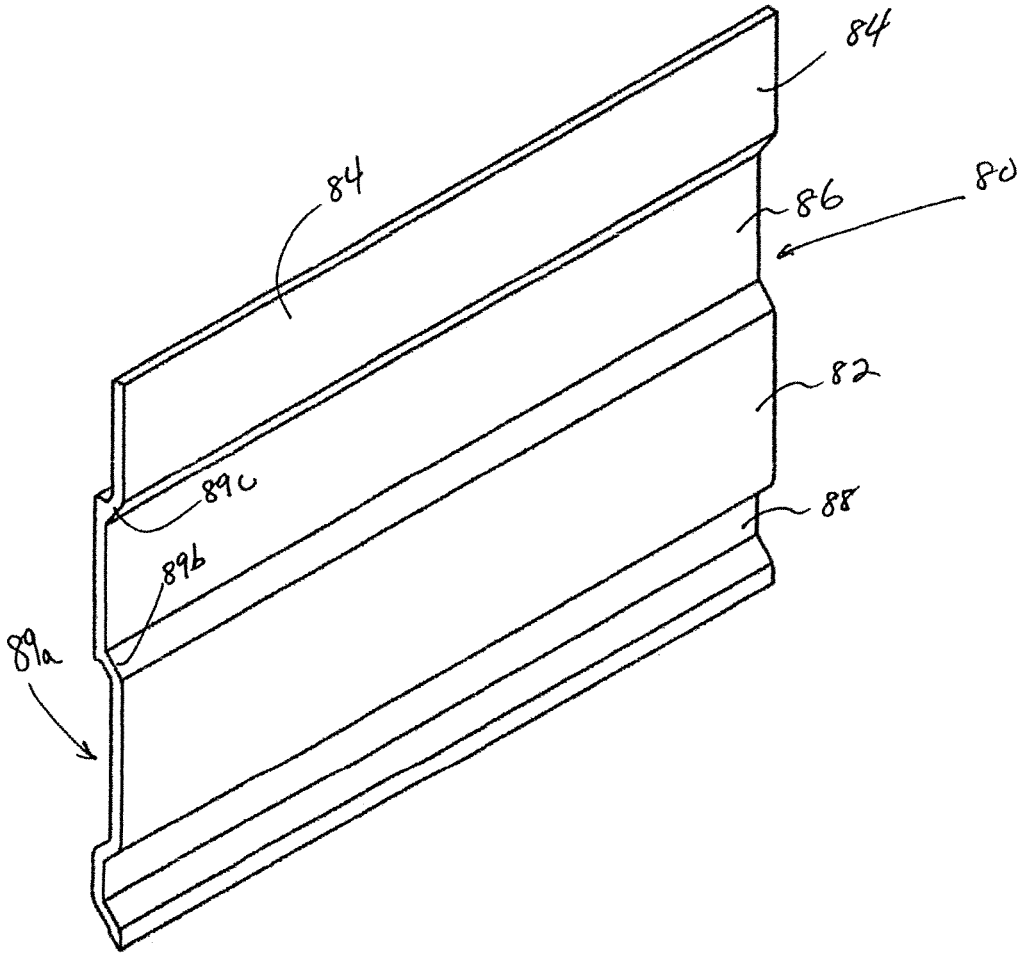
FIGS. 12A through 12F illustrate perspective, front elevational, rear elevational, top plan, bottom plan, and left side elevational views of the first attachment rail of FIG. 3.
Figure 12B:
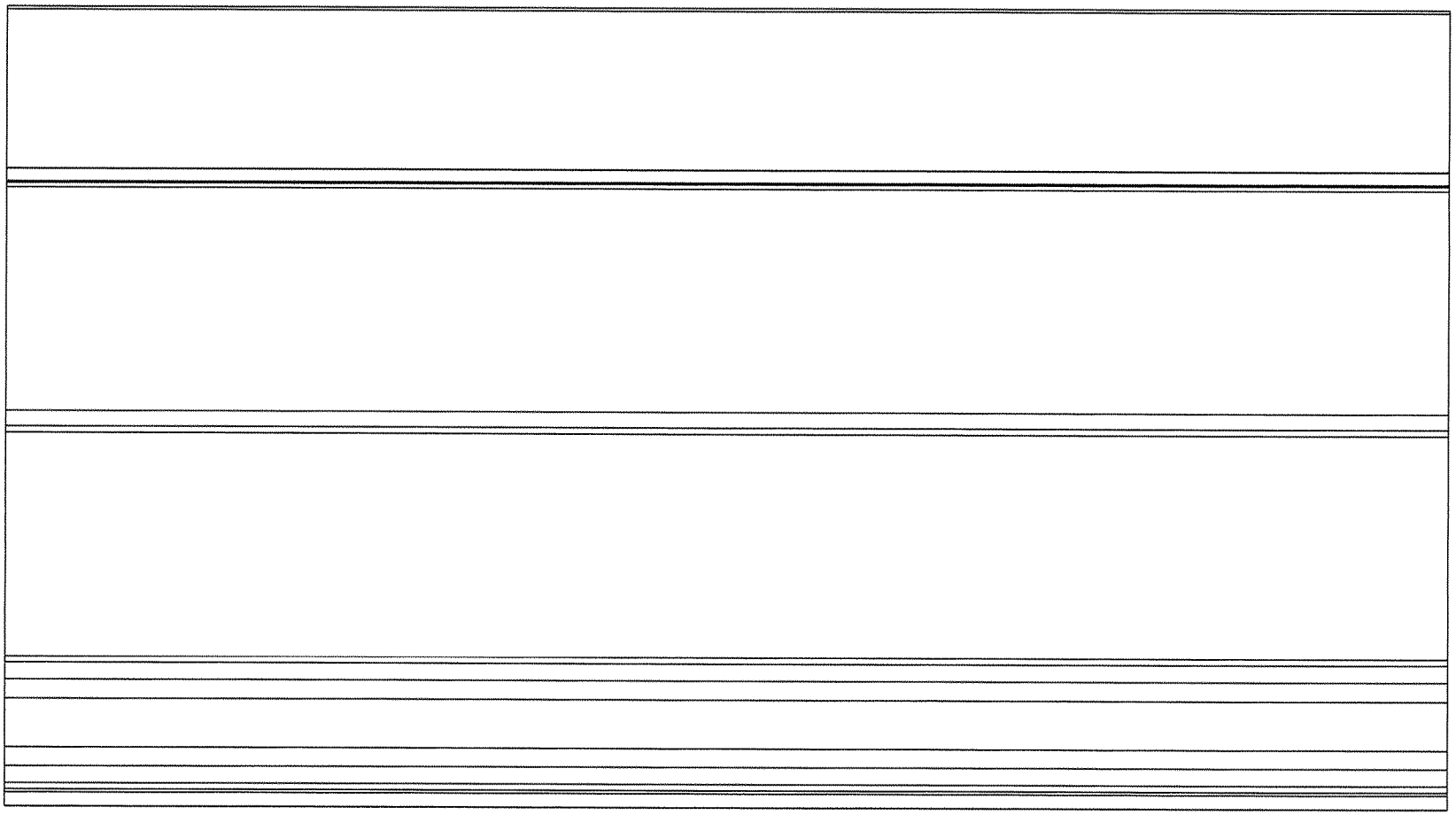
Figure 12C:
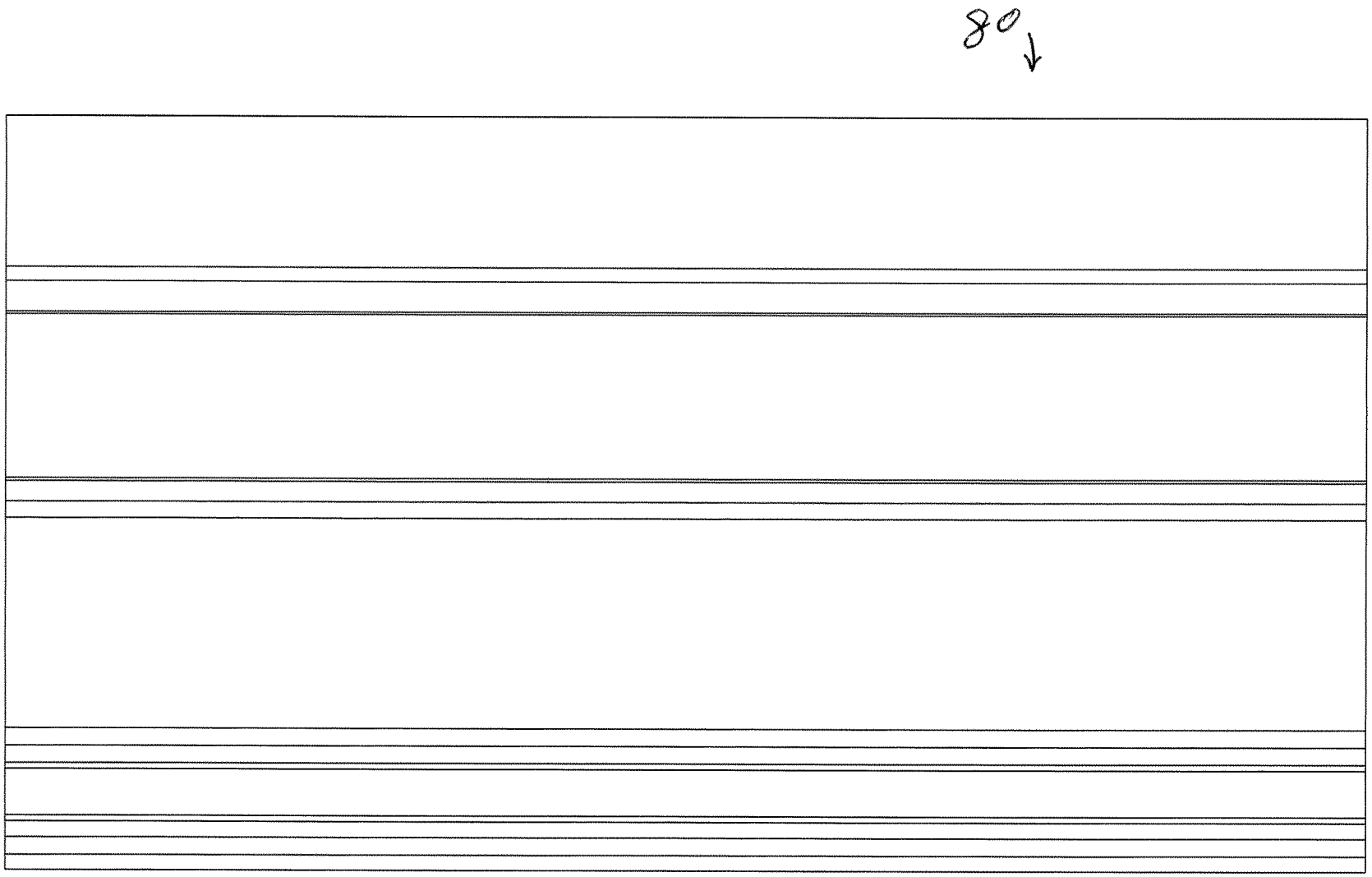
Figure 12D:
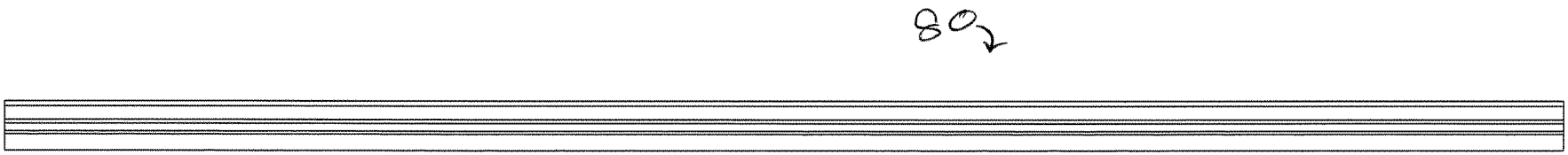
Figure 12E:
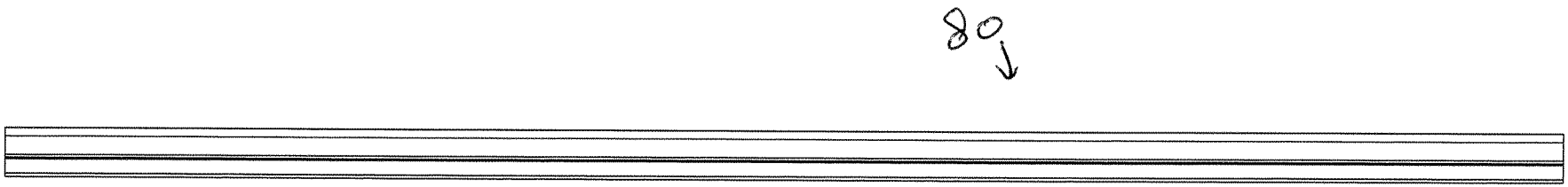
Figure 12F:
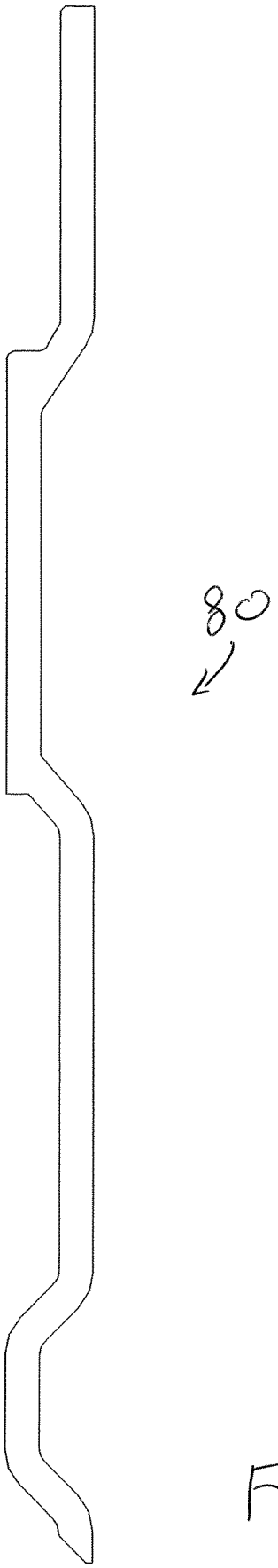
Figure 13A:
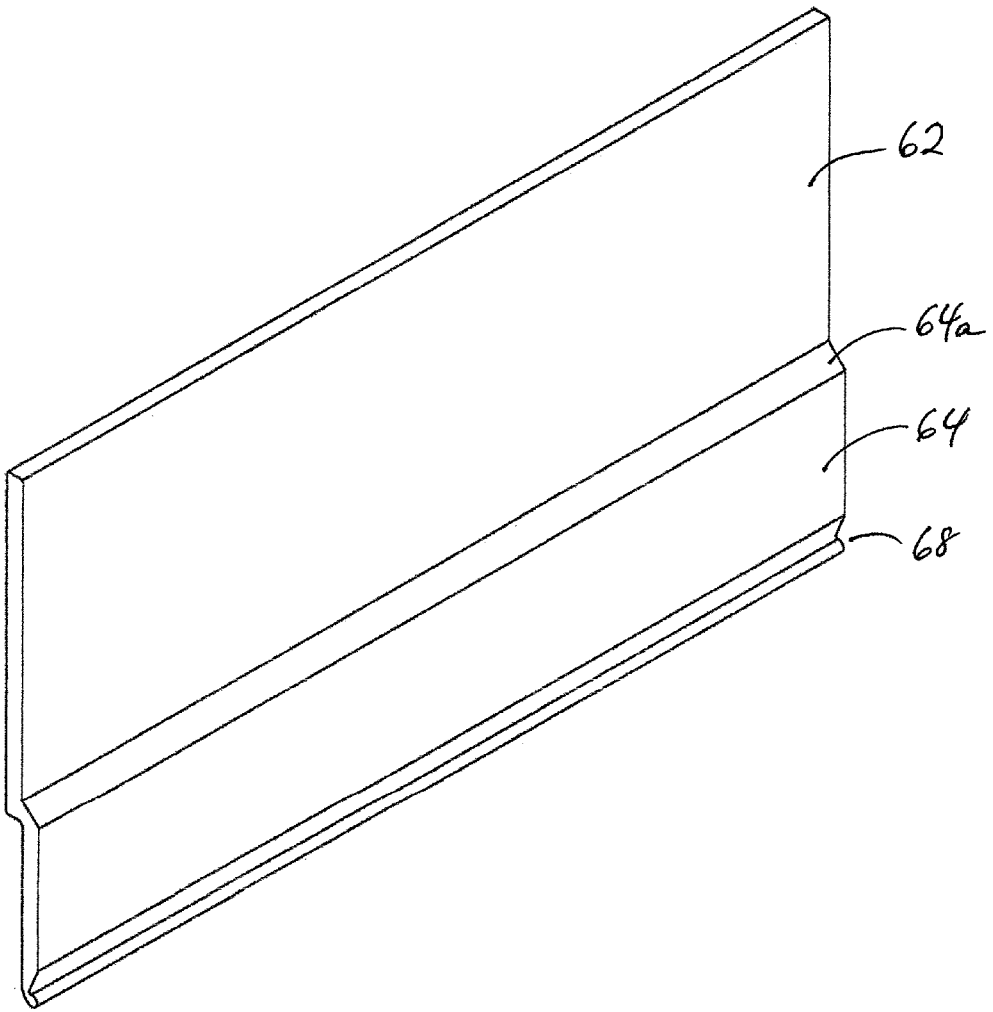
FIGS. 13A through 13F illustrate perspective, front elevational, rear elevational, top plan, bottom plan, and right side elevational views of the second attachment rail of FIG. 3.
Figure 13B:
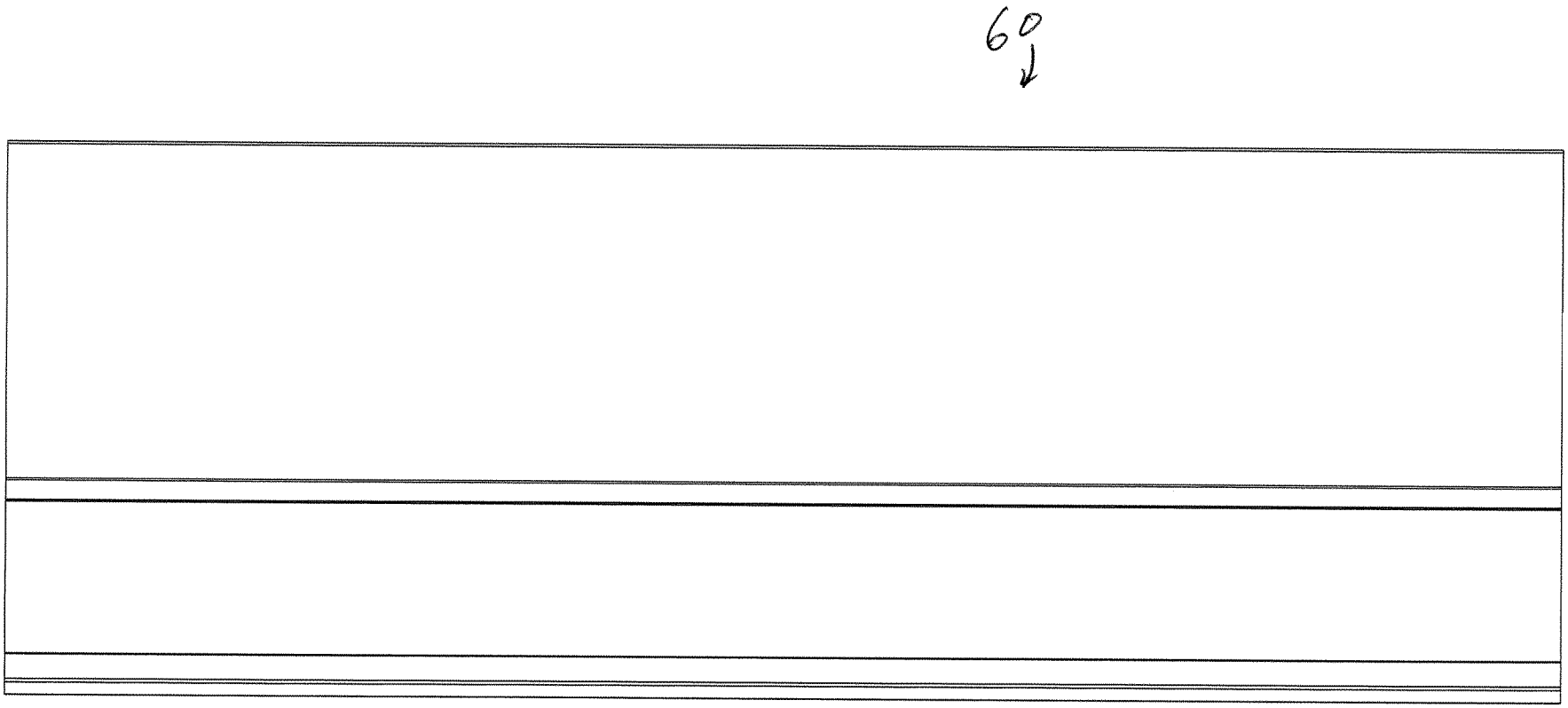
Figure 13C:
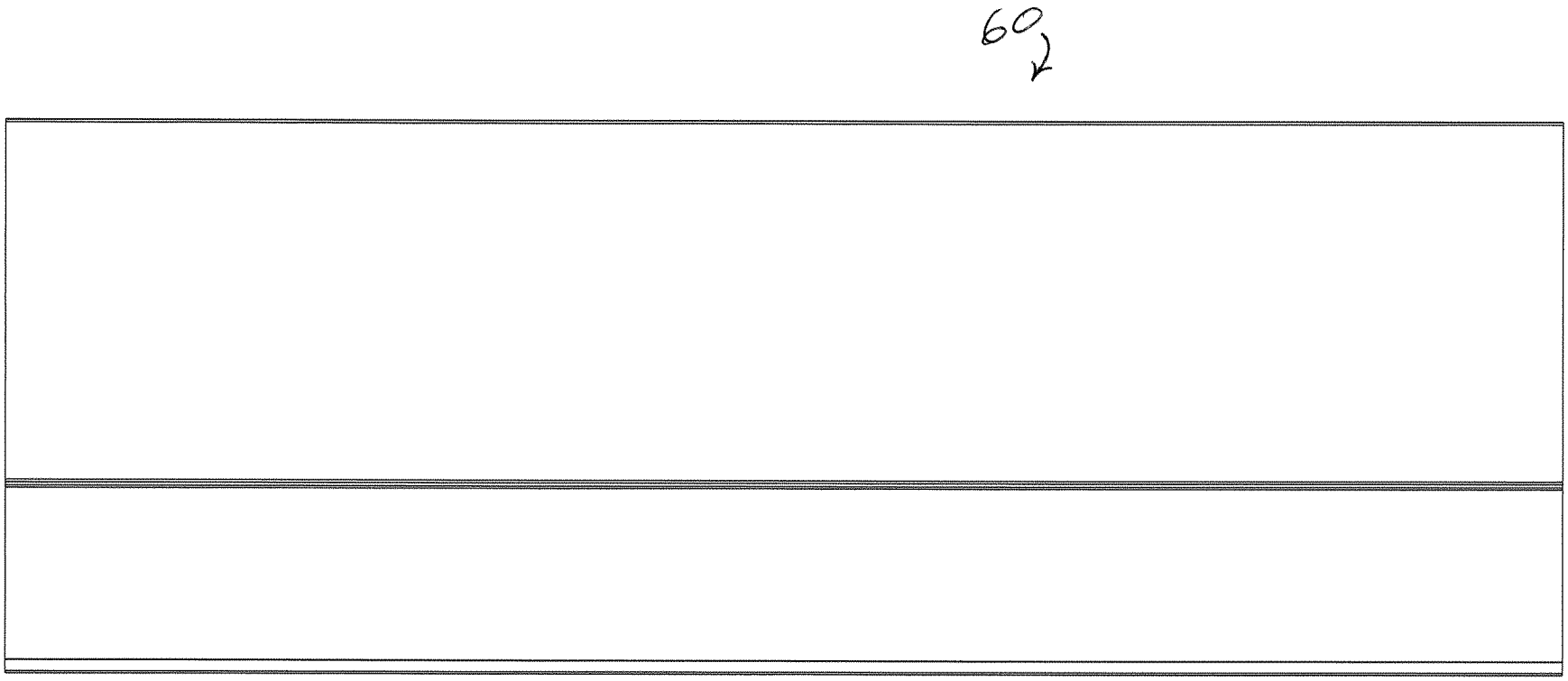
Figure 13D:
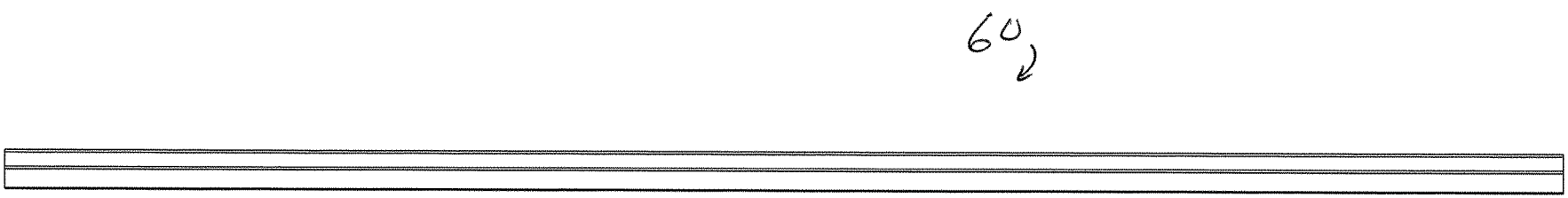
Figure 13E:
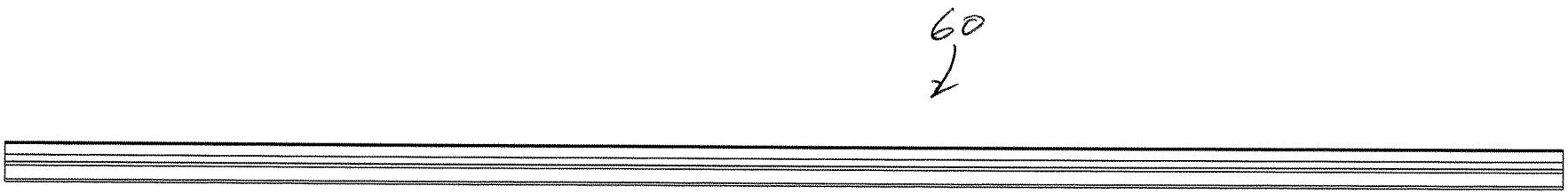
Figure 13F:
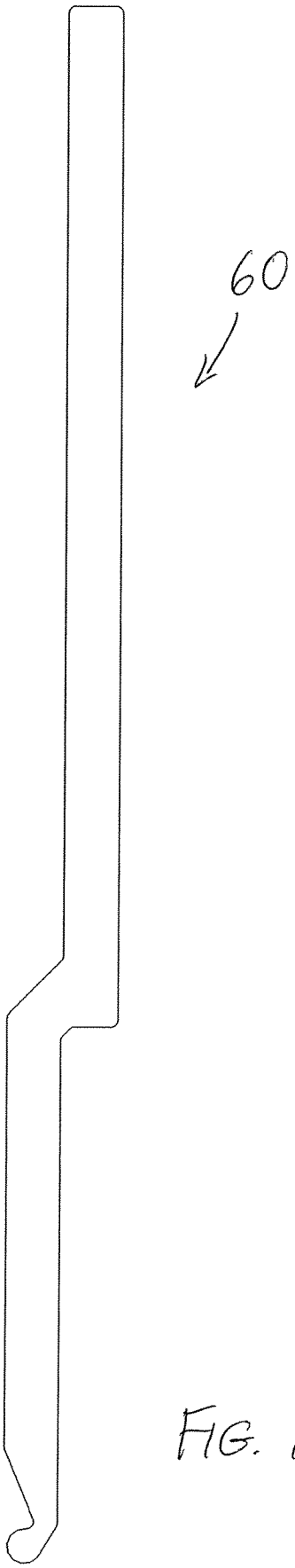

FIG. 1 illustrates an exemplary anchoring system 10 in accordance with an exemplary embodiment of the present disclosure. The exemplary anchoring system 10 includes a mounting bracket or slab bracket 20 that is fastened onto an exposed frontal edge 3 of a floor slab 2. As also shown in FIGS. 9 and 10, the exemplary slab bracket 20 includes a base plate or base wall or base plate 23, a first forwardly extending flange 24 and a second forwardly extending flange 26, forming a "double T" structure. In alternative embodiments, the slab bracket 20 may have just one forwardly extending wall (either 24 or 26), or alternatively, have three or more parallel forwardly extending walls.

The first and second forwardly extending flanges 24 and 26 are in a parallel and spaced apart configuration with each other, each extending from the base plate 23 at an angle, for example, a right angle 22. A gap or channel 28 is provided between the first and second forwardly extending flanges 24 and 26 for receiving and retaining a connector tube 40 therebetween. The base plate 23 extends laterally beyond the forwardly extending flanges 24, 26 to define laterally extending flanges 29*b*, which include mounting holes 30*a* for attaching the slab bracket 20 to the butt end or edge 3 of the floor slab 2, using a plurality of fasteners 30*b*. In other arrangements, the slab bracket 20 may be mounted to a surface of a vertically extending building wall substrate, for example, to secure a façade panel to a building wall exterior.

Each forwardly extending flange 24 and 26 includes a plurality of fastener openings 32, where each fastener opening 32*d* on one of the first forwardly extending flange 24 having a coaxial or parallel opening 32*e* on the second forwardly extending flange 26, such that a fastener may be threaded or otherwise run across the gap 28 from one fastener opening 32*d*, through aligned holes in the inserted connector tube 40, to its co-axial fastener opening 32*e*. In other embodiments, separate fasteners (e.g., screws) may be installed in the first and second flanges 24, 26 for attachment to the side walls of the inserted connector tube.

As shown in FIG. 1, the fastener openings 32*d* and 32*e* form vertical slots to enable for fine vertical adjustment of the connector tube 40 in vertical up or down directions 32*h*. The fastener openings 32*d* and 32*e* are further supplemented by a plurality of mounting holes (e.g., circular openings) 32*f* on the first forwardly extending flange 24, having co-axial fastener openings 32*g* on the second forwardly extending flange 26. The exemplary openings 32*f* and 32*g* are circular, with the diameter just large enough to allow a passage of a fastener therethrough, and without enabling of any shift in position of such fastener either in the vertical elevation direction 32*h* or in and out of plane 32*i*. The purpose of openings 32*f* and 32*g* is to reinforce the final positioning of fasteners within the slots 32*d* and 32*e*. While not shown, additional opening slots may be provided on the first and second forwardly extending flanges 24 and 26 to accommodate for fine adjustment of the connector tube 40 in the back-and-forth direction 32*i*. The flanges 29*b* have a plurality of fastener openings 30*a*, which may be horizontal slots as shown, or a combination of vertical and horizontal slots. The horizontally slotted openings 30*a* enable fine left and right adjustment of the slab bracket 20 in the direction 32*j*.

The exemplary connector tube includes a rectangular cuboid section 41 having two parallel side walls 42 spanned along one edge by a butt end wall 44 and along an opposite edge by an attachment wall 46, which as shown may be planar to facilitate fastener attachment and attachment rail abutment. While the attachment wall may terminate at the side walls 42, in the illustrated embodiment, a section of the attachment wall 46 overhangs the rectangular cuboid section 41, forming a laterally extending flange 48*b*. In other embodiments, the attachment wall may extend beyond both side walls to form two laterally extending flanges (not shown). The flange portions of the attachment wall may provide for additional bracing engagement with the first attachment rail, as described in greater detail below. Further, the attachment wall may have a thickness that is greater (e.g., at least about 50% greater) than a thickness of the first and second side walls 42, for example, to provide increased rigidity and reinforcement of the anchoring system 10.

The vertical length of all walls forming the connector tube 40 may be uniform and may (though need not) be somewhat greater than the length 25 of the slab bracket 20. In an exemplary embodiment, the connector tube 40 has a vertical length between about 25% greater and about 100% greater than a vertical length of the slab bracket 20. The butt end 44 of the connector tube may be adjoined with each of the two parallel walls 42 by diagonal walls 44*c*, with each diagonal wall 44*c* forming a tapered surface that may be useful in facilitating insertion of the butt end wall 44 into the channel or gap 28 during assembly.

Figure 2:
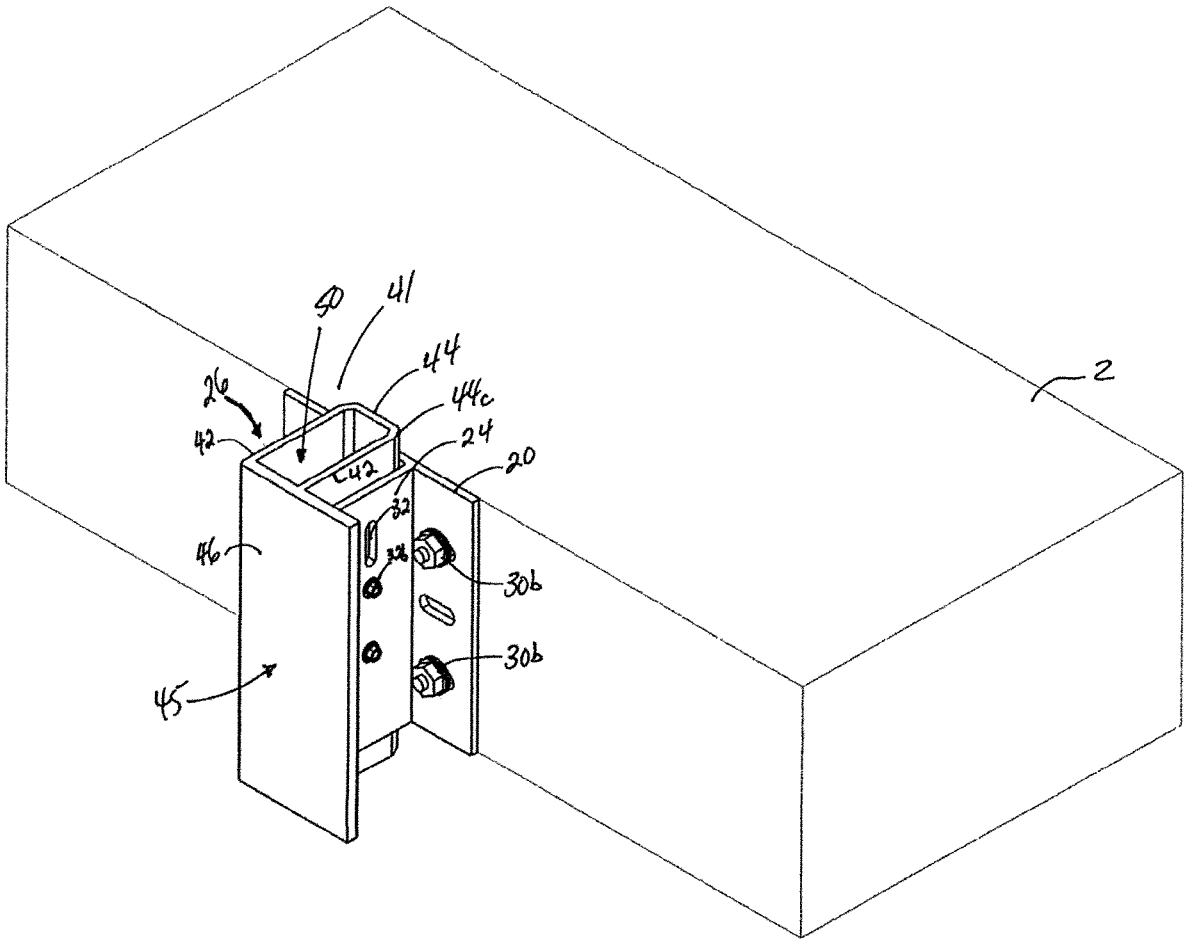
FIG. 2 illustrates a perspective view of the slab bracket and connector tube of FIG. 1, shown with the connector tube assembled with the slab bracket.

FIG. 2 illustrates the retention of the rectangular cuboid section 41 within the slab bracket 20. It is intended that most of (e.g., more than half of, to substantially all of) the rectangular cuboid section 41 is retained within the gap 28 between the first and second forwardly extending flanges 24 and 26, with the attachment wall 46 presenting an outer surface 45 that serves as a mounting point to the panel. The fasteners 32*b* may be configured to perforate each of the two parallel walls 42 across or into the channel 28. The plurality of openings 32 on each of the first and second forwardly extending flanges 24 and 26 include vertically elongated slots that offer additional up and down adjustment for each section of façade paneling. In some embodiments, elongated bolt fasteners may be installed through aligned holes in the forwardly extending flanges 24 and 26 and connector tube side walls 42 for secure attachment of the connector tube 40 to the slab bracket 20. In other embodiments, self-tapping screws may be installed through the slab bracket openings 32 to tap holes in the connector tube 40 to provide secure, fixed positioning of the connector tube in the slab bracket. In still other embodiments, one or more compressible (e.g., plastic) shims may be positioned between the connector tube walls 42 and the slab bracket flanges 24, 26, for example, to prevent or minimize lateral movement of the connector tube 40 within the slab bracket 20.

In an exemplary attachment of the connector tube 40 to the slab bracket 20, the connector tube may be initially loosely attached with the slab bracket by installing fasteners (e.g., self-tapping screws) through the vertical slots 32*d*, 32*e* (FIGS. 1, 9) and into the side walls 42 of the connector tube 40. After suitable vertical adjustments of the connector tube 40 within the vertical channel 28 of the slab bracket 20, the connector tube may be secured in the selected vertical position by installing additional fasteners through mounting holes 32*f*, 32*g* (FIGS. 1, 9) in the flanges 24, 26 and into the connector tube side walls 42. While the channel or gap 28 is shown oriented substantially vertically, thereby forming a vertical channel along the edge 3, channel or gap may be configured to additionally or alternatively extend more horizontally or at an angle from a vertical or horizontal axis of the edge 3, to provide for positional adjustments in different directions.

Figure 3:
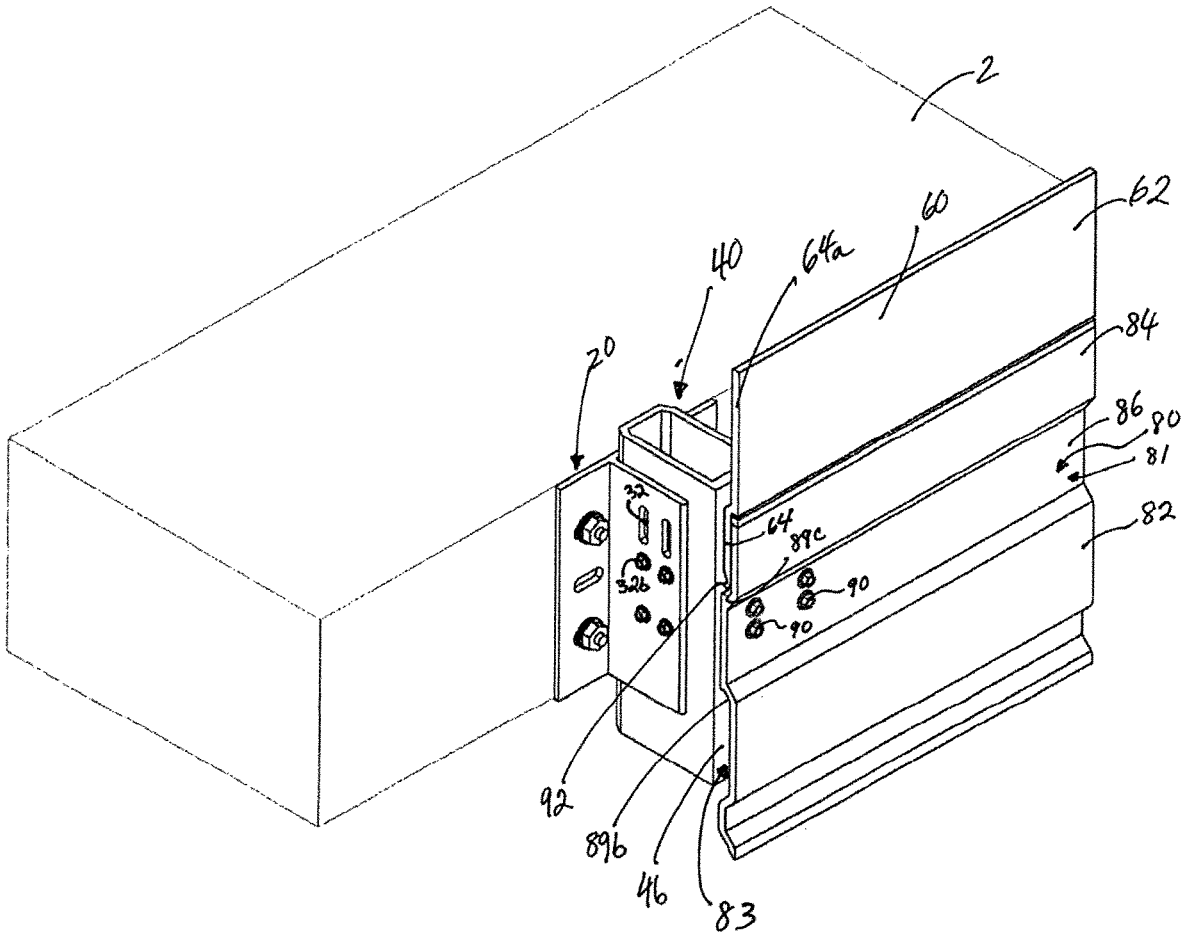
FIG. 3 illustrates a perspective view of an anchoring system including the slab bracket and connector tube of FIG. 1, with first and second attachment rails secured to the connector tube, in accordance with an exemplary embodiment of the present disclosure.

FIG. 3 illustrates a combination of a first attachment rail 80 secured with a first, lower façade panel (as described below) that interlocks with a second attachment rail 60 secured with a second, upper façade panel (as described below). The first attachment rail 80 is attachable with fasteners 90 to the outer surface of the attachment wall 46. While many different rail configurations may be used, in the illustrated embodiment, the first attachment rail 80 is substantially S-shaped and includes a first wall or first panel fastening wall 82, a second wall or mounting wall 86 and a third wall or support wall 84. A first diagonal spacer wall 89*b* provides an offset between the first panel fastening wall 82 and the mounting wall 86. As will be shown in further figures, the first panel fastening wall 82 is attached close to an upper edge of a lower panel section or façade panel, while the mounting wall 86 is attached to the connector tube attachment wall 46. Therefore, the first panel fastening wall 82 is spaced apart from the attachment wall 46 to define a first gap 83 for fasteners perforating the first panel fastening wall and attaching the lower façade panel 6 (as shown in FIGS. 4 and 5), and a second gap 81 to permit the S-shaped attachment rail 80 to be fastened to the connector tube attachment wall 46 with fasteners 90.

Figure 6:
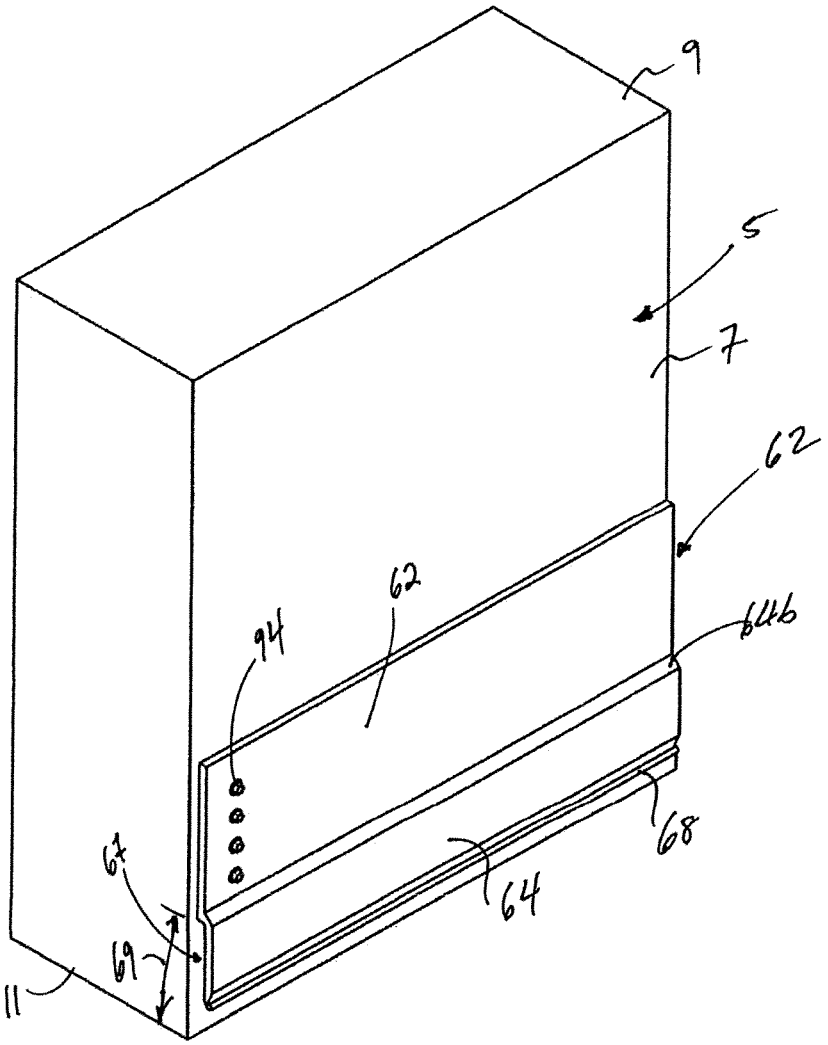
FIG. 6 illustrates a perspective view of a second façade panel secured to the second attachment rail of FIG. 3.
Figure 7:
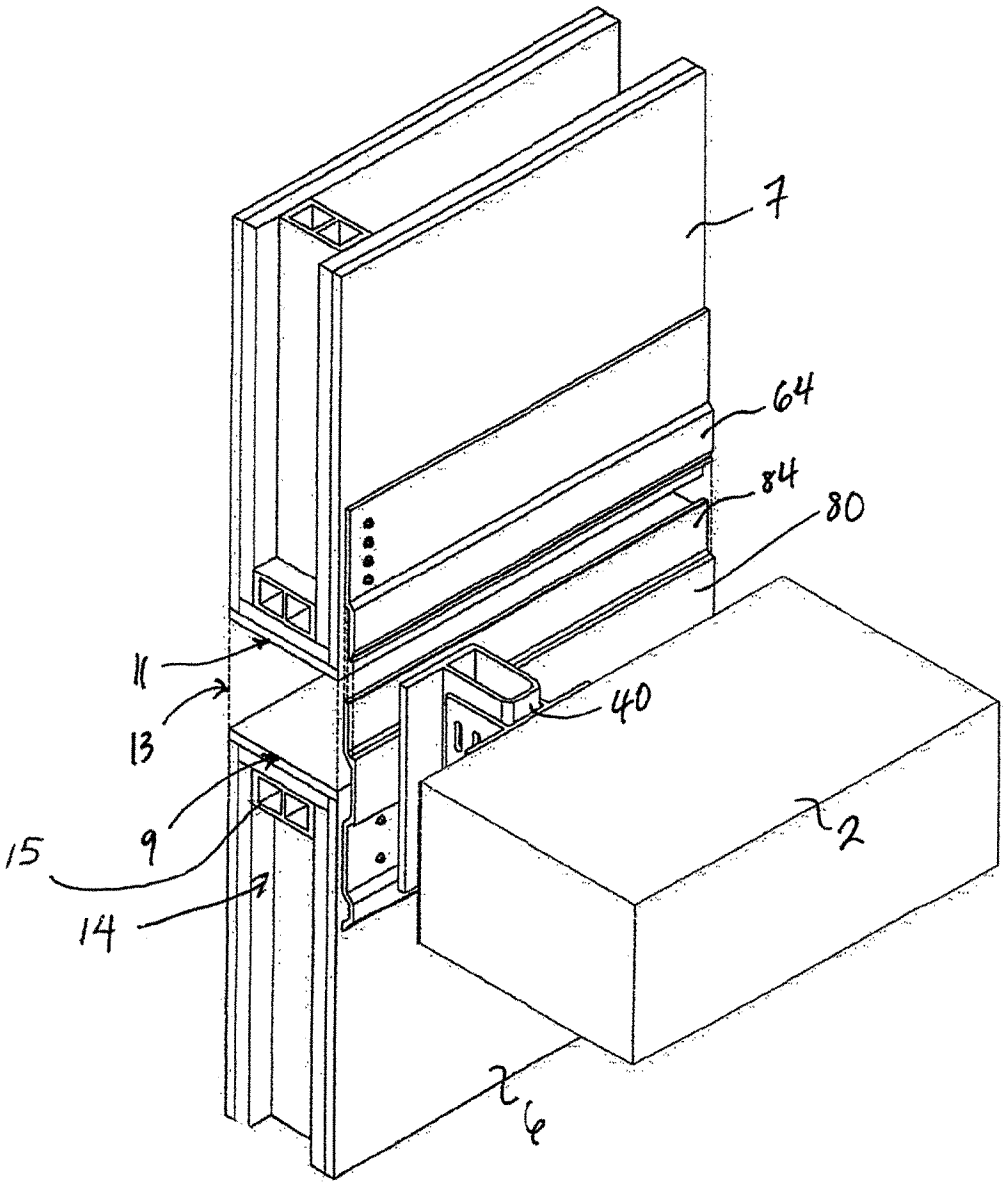
FIG. 7 illustrates a perspective view of the anchoring system of FIG. 3, with a first façade panel secured to the connector tube by the first attachment rail, and a second façade panel and second attachment rail aligned for assembly with the first façade panel and first attachment rail.

A second diagonal spacer 89*c* provides an offset between the mounting wall 86 and the support wall 84. When the S-shaped attachment rail 80 is attached to the connector tube attachment wall or face 46, the attachment wall, the second diagonal spacer 89*c* and the support wall 84 create a U-shaped channel of first slot 92. The U-shaped channel or first slot 92 is used to capture a hanger wall portion 64 of a second (e.g., Z-shaped, or other suitable shapes/configurations) attachment rail 60 secured with an upper façade panel. The hanger wall 64 is separated from a second panel fastening wall 62 by a spacer wall 64*a*. The diagonal orientation of the spacer wall 64*a* provides an offset between the hanger wall 64 and the second panel fastening wall 62, with the hanger wall 64 being co-extensive with the mounting wall 86 of the first attachment rail 80 and the second panel fastening wall 62 being flush with the support wall 84 in an interlocking assembly. As shown in FIGS. 6 and 7, the second panel fastening wall 62 is mounted onto the lower edge of the upper façade panel 7.

Figure 4:
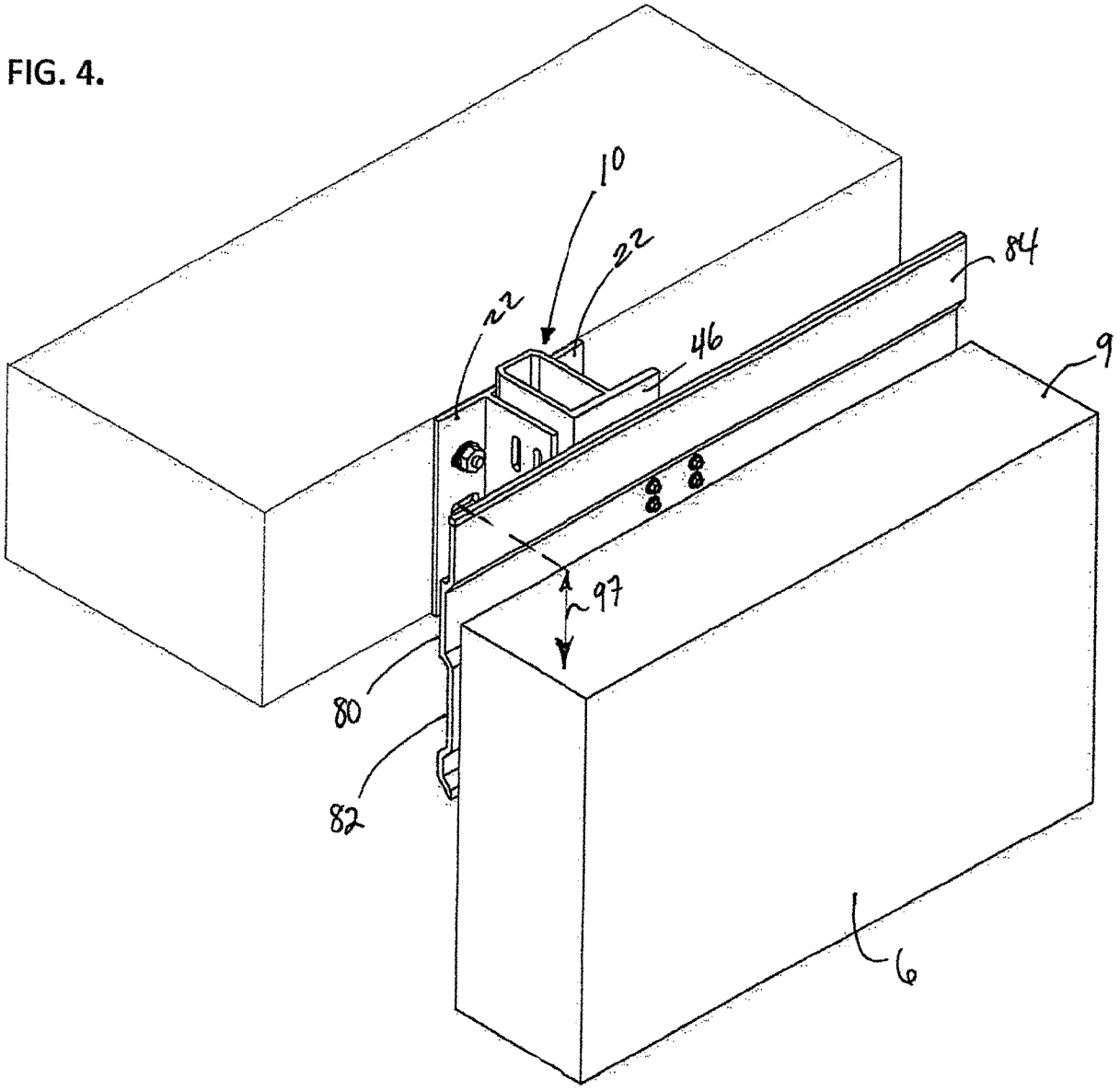
FIG. 4 illustrates a perspective view of the slab bracket and connector tube of FIG. 1 with the first attachment rail of FIG. 3 secured to the connector tube and a first façade panel secured to the first attachment rail.
Figure 5:
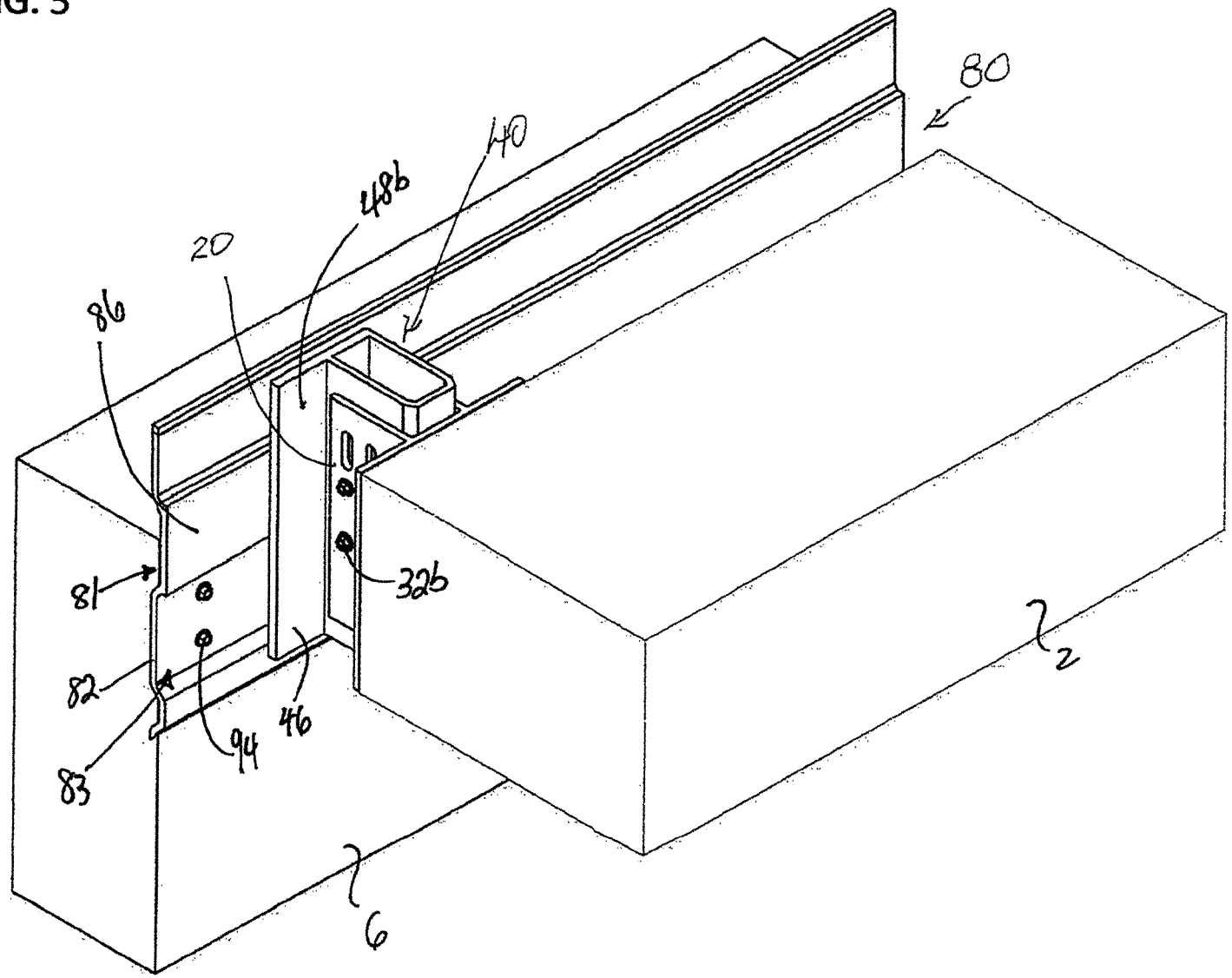
FIG. 5 illustrates another perspective view of the slab bracket and connector tube of FIG. 1 with the first attachment rail of FIG. 3 secured to the connector tube and a first façade panel secured to the first attachment rail.

FIG. 4 illustrates the first step in attaching a section of the façade wall to the anchoring system 10. As shown, the lower façade panel 6 is attached to the first panel fastening wall 82 near its upper edge 9 of the lower wall panel 6.

The distance 97 between the top edge 9 and the top of the S-shaped attachment rail 80 is then almost entirely used for mounting the upper panel 7. FIG. 5 illustrates the fasteners 94 that are deployed within the first gap 83. The mounting wall 86 mounts onto the connector tube attachment wall 46, with the recessed second gap 81 providing clearance for the fasteners thereof. Additional fasteners for mounting the S-shaped attachment rail 80 may be installed through the flange section 48*b*.

FIG. 6 illustrates the upper wall or façade panel 7 or one which is placed above the lower façade panel 6 shown in FIGS. 5 and 6. The second panel fastening wall 62 of the Z-shaped attachment rail is attached to the inner surface 5 of the upper façade panel 7 near the bottom edge 11, with the hanger wall 64 extending downward. The hanger wall 64, the tapered spacer 64*b* and the inner surface 5 of the upper façade panel 7 combine to form a U-channel or second slot 67 for retaining the support wall 84 of the S-shaped attachment rail 80 (see FIG. 7). In one embodiment, the distance 69 from the spacer 64*b* to the bottom edge 11 may be equal to or slightly smaller than the distance 97 between the lower panel top edge 9 and the top of the S-shaped attachment rail 80 (FIG. 4), for example, to ensure full interlocking engagement of the hanger wall 64 and the support wall 84. The second panel fastening wall 62 is shown as having an extended vertical length (e.g., greater than a vertical length of the hanger wall 64) to accommodate additional fasteners 94.

Figure 8:
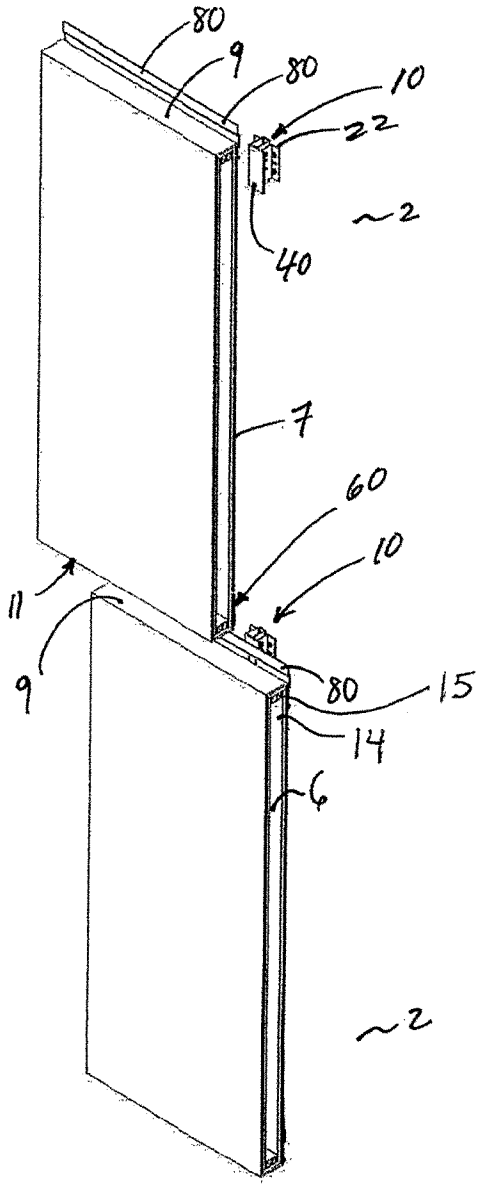
FIG. 8 illustrates a perspective view of the first and second façade panels secured together by the anchoring system of FIG. 7.

To secure an upper edge of the second, upper façade panel 7 to the building structure (e.g., to an upper portion of a building wall or to an upper floor slab), another attachment rail (e.g., S-shaped attachment rail 80) may be attached near the upper edge 9 thereof, as shown in FIG. 8. In some such arrangements, a third façade panel above the second panel 7 may similarly be secured with the second panel using a Z-shaped attachment rail along a lower edge, to provide a similar interlocking connection between the second and third façade panels, as between the first and second façade panels. The sequence of mounting façade panels using the S-shaped attachment rail near the top edge 9 of a lower panel, combined with a Z-shaped attachment rail near the bottom edge of the next upper wall panel continues throughout the floor levels until the structure is built. The pattern is illustrated further in FIGS. 7 and 8, which show the anchor system 10 comprised of the slab bracket 20 retaining a connector tube 40 mounting at an edge of each floor slab 2. An S-shaped attachment rail is mounted close to the upper edge 9 of the lower façade panel 6, with a Z-shaped attachment rail mounting toward the lower edge 11 of a panel 7 that is immediately overhead, and this pattern continues until the façade is completed.

Figure 7A:
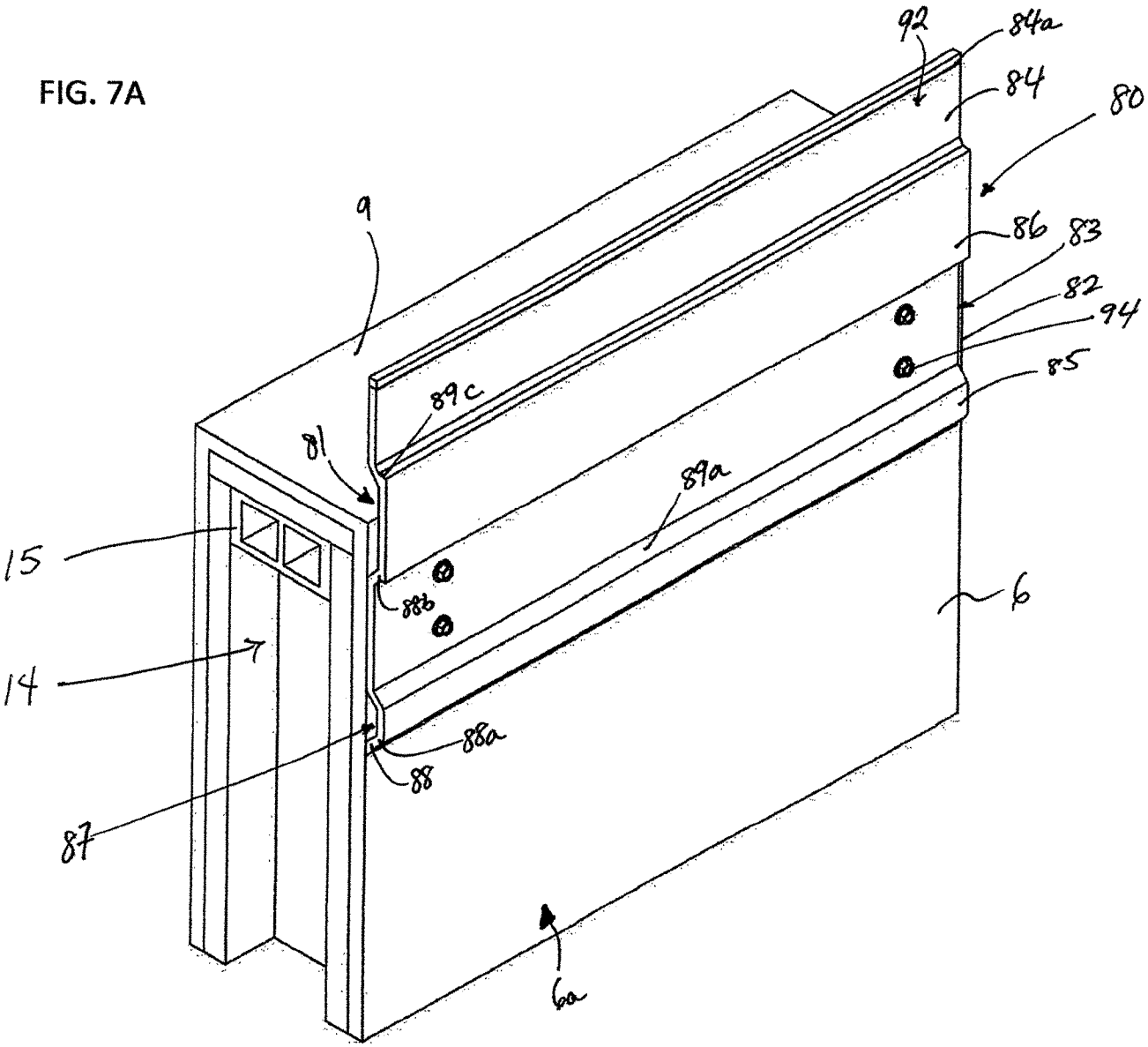
FIG. 7A illustrates a perspective view of the first attachment rail and first façade panel of FIG. 7.

FIGS. 7 and 7A illustrate the S-shaped attachment rail 80 secured with a façade panel. As shown, the S-shaped attachment rail 80 may be provided with a tube bracing wall 85 that abuts the attachment wall 46 of the connector tube 40, for example to brace the lower end of the connector tube against the S-shaped attachment rail 80. As shown, the tube bracing wall 85 may be coplanar with the mounting wall 86, and vertically spaced from the mounting wall by the first panel fastening wall 82. The S-shaped attachment rail 80 may further be provided with a panel bracing wall 88 that abuts the rear surface of the façade panel 6, for example, to brace the lower end of the attachment rail 80 against the façade panel. As shown, the panel bracing wall 88 may be coplanar with the first panel fastening wall 82, and vertically spaced from the first panel fastening wall by the tube bracing wall 85. The panel bracing wall 88, shown as provided at the lower edge of the S-shaped attachment rail, is separated from the tube bracing wall 85 by a lower spacer 88*a*. The panel bracing wall 88 and the tube bracing wall 85 are shown in a parallel but obliquely separated orientation to each other by the lower spacer 88*a*.

In such an arrangement, the panel bracing wall 88 is flush with the surface 6*a* of the lower façade panel 6. Protruding outwardly away from the surface 6*a* is the lower spacer 88*a*. Issuing from the free end of the lower spacer 88*a* is the lower wall 85 which is configured to be parallel to and set apart from the surface 6*a*. Issuing from the free end of the lower wall 85 is the first spacer 89*a*, which connects the lower wall 85 to the first wall 82. The first wall 82 being directly flush with and parallel to the surface 6*a*. The lower spacer 88*a*, the lower wall 85 and the first spacer 89*a* creating the lower cavity 87. The lower cavity 87 provides additional rigidity for the S-shaped rail 80 as well as serves as an additional insulating measure against any elements that may penetrate and/or span the gap 13 between the upper edge 9 and the lower edge 11 (see FIG. 7). Along the edge of the first wall 82 that is opposite to the first spacer 89*a*, is the second spacer 89*b*, which protrudes outwardly away from the surface 6*a*. The free edge of the second spacer 89*b* connects to the second wall 86, and a third spacer 89*c* protrudes from the edge of the second wall 86 opposite from the second spacer 89*b*, with the second edge 89*b*, the second wall 86 and the third spacer 89*c* creating a second gap 81. Notably, the second gap 81 is opposite the gap 13 between lower and upper panels 6 and 7. Issuing upwardly from the third spacer 89*c* is the third wall 84. Thus, the lower edge 88, the first wall 82 and the third wall 84 are all along the same vertical axis that is parallel to and flush against the wall panels 6 or 7, and in parallel but set apart configuration is the vertical axis orienting the lower wall 85 and the second wall 86.

In the embodiment of the S-shaped rail 80 shown in FIG. 7A the second wall may be wider than the embodiment shown in FIG. 7, to accommodate additional or larger fasteners 94. In some embodiments, the length 84*a* of the S-shaped rail 80 is substantially equal to the entire width of a wall panel 6.

Figure 8A:
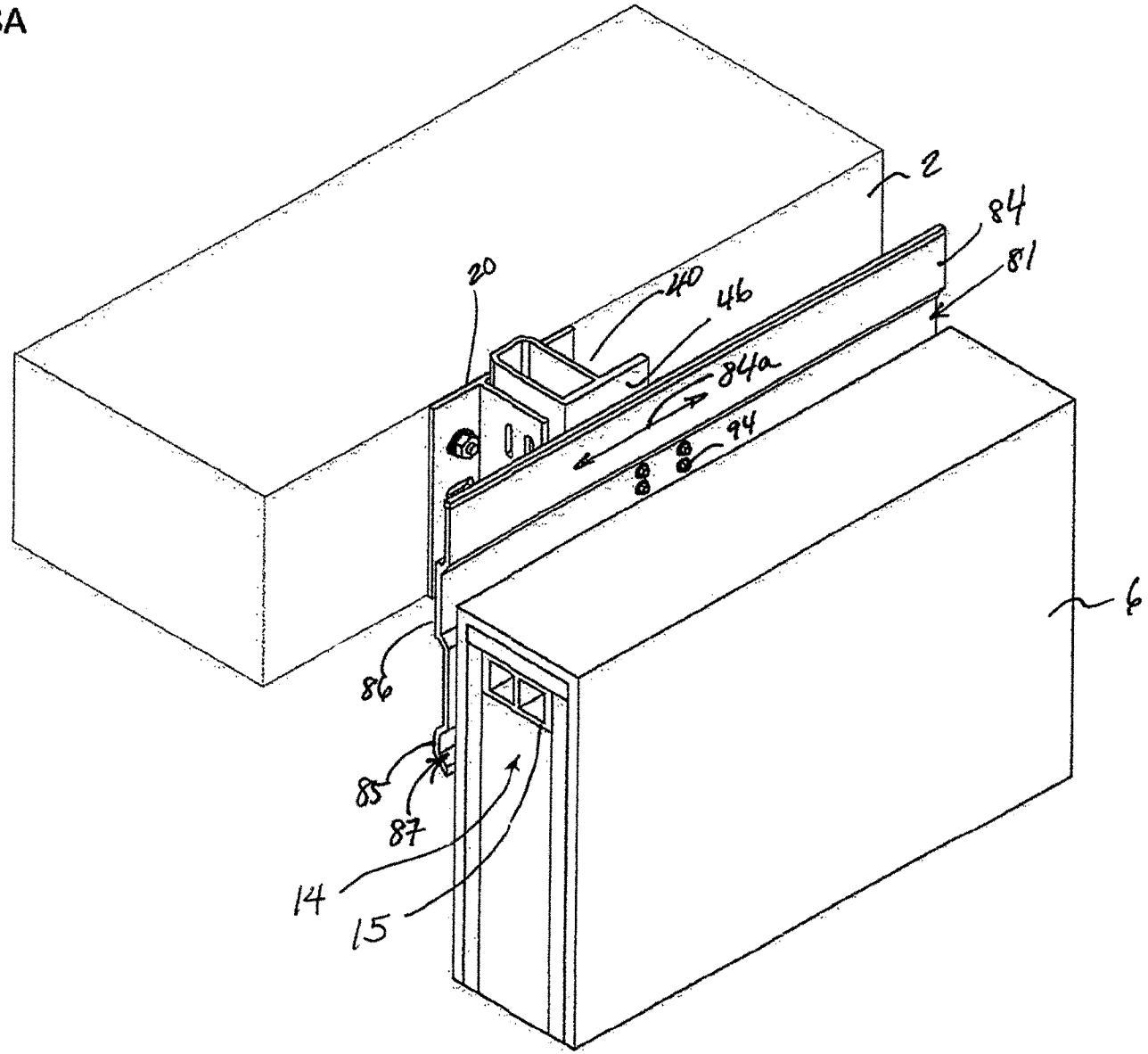
FIG. 8A illustrates a perspective view of the slab bracket and connector tube of FIG. 1 with the first attachment rail of FIG. 3 secured to the connector tube and the first façade panel of FIG. 7 secured to the first attachment rail.

Illustrated in FIG. 7A is the attachment of the S-shaped rail 80 to the surface 6*a* of a wall panel 6, with the first gap 83 providing the necessary clearance to conceal the fasteners 94 therein. FIG. 8A illustrates the point of attachment of the S-shaped rail 80 to the connector tube 46 of the connector tube 40 in the embodiment of the S-shaped rail 80 both the second wall 86 and the lower wall 85 are flush against the connector tube 46 and may be used to fasten the S-shaped rail to the connector tube 46. An additional feature that may be present along the free edge of the third wall 84 is a barb protrusion 84*a* extending into the U-shaped channel 92. The barb protrusion 84 interacting with the lower lip 68 of the Z-shaped rail 60 to create an interlocking joint (e.g., "snap joint") between the third wall 84 and the second wall 64 of the Z-shaped rail 40.

Figure 8B:
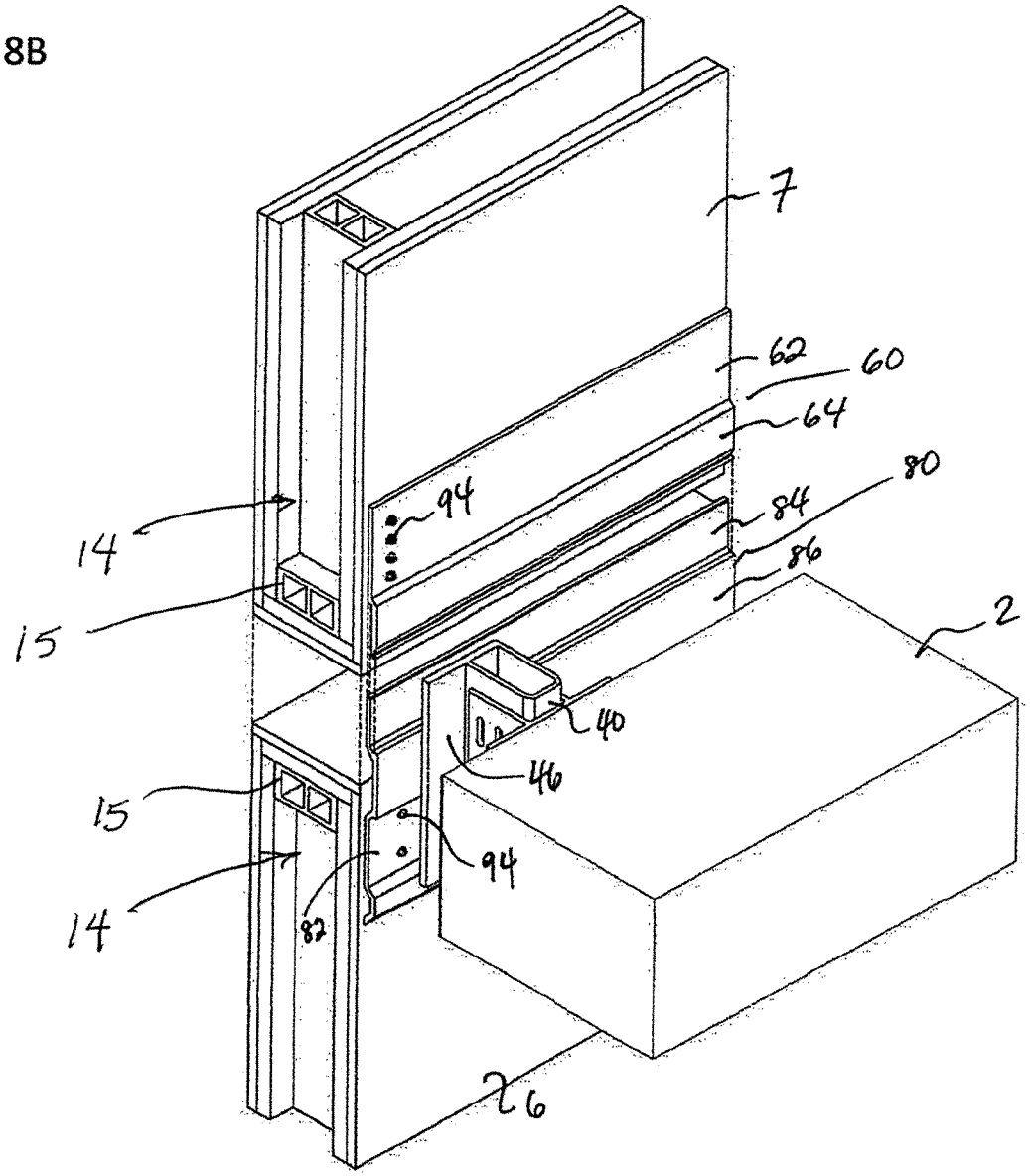
FIG. 8B illustrates the assembly of FIG. 8A, with the second façade panel and second attachment rail of FIG. 7 aligned for assembly with the first façade panel and first attachment rail.

FIG. 8B illustrates the assembly of the Z-shaped rail 60 and the S-shaped rail 80 that is shown in FIGS. 7A and 8A. The broader surfaces of the first wall 62 of the Z-shaped rail 60 and the first wall 82 provide a broader spacing for fasteners 94, which in turn may prevent any potential cracking in the surface of the wall panels 6 and 7, which may occur when fasteners 94 are close together.

The wall panels or façade panels 6, 7 may be formed from one or more of a variety of materials, including, for example, glass, concrete, wood, metal, plastic, or composite materials. In one embodiment, the façade panels are formed as structural façade panels having internal framing (surrounded, for example, by insulation and/or base coat materials) spanning the height and width of each panel, providing rigid reinforcement along the panels. Such an arrangement allows for secure mounted attachment of the panels to a building structure at discrete anchor point locations (e.g., at the slab bracket and connector tube locations described herein). In some embodiments, as shown in FIGS. 7, 7A, 8, 8A, and 8B, each façade panel 6, 7 includes a panel body having a rigid framing arrangement 14 with an outer boundary frame portion 15 extending around an outer perimeter of the panel body, with the attachment rail being secured to the panel body by one or more fasteners installed into the outer boundary frame portion. Exemplary structural panels having rigid internal framing for attachment to a mounting/anchoring system are described in the above incorporated '361 Application.

FIGS. 9-13F present various views of exemplary components of the disclosed system in greater detail.

Figure 14:
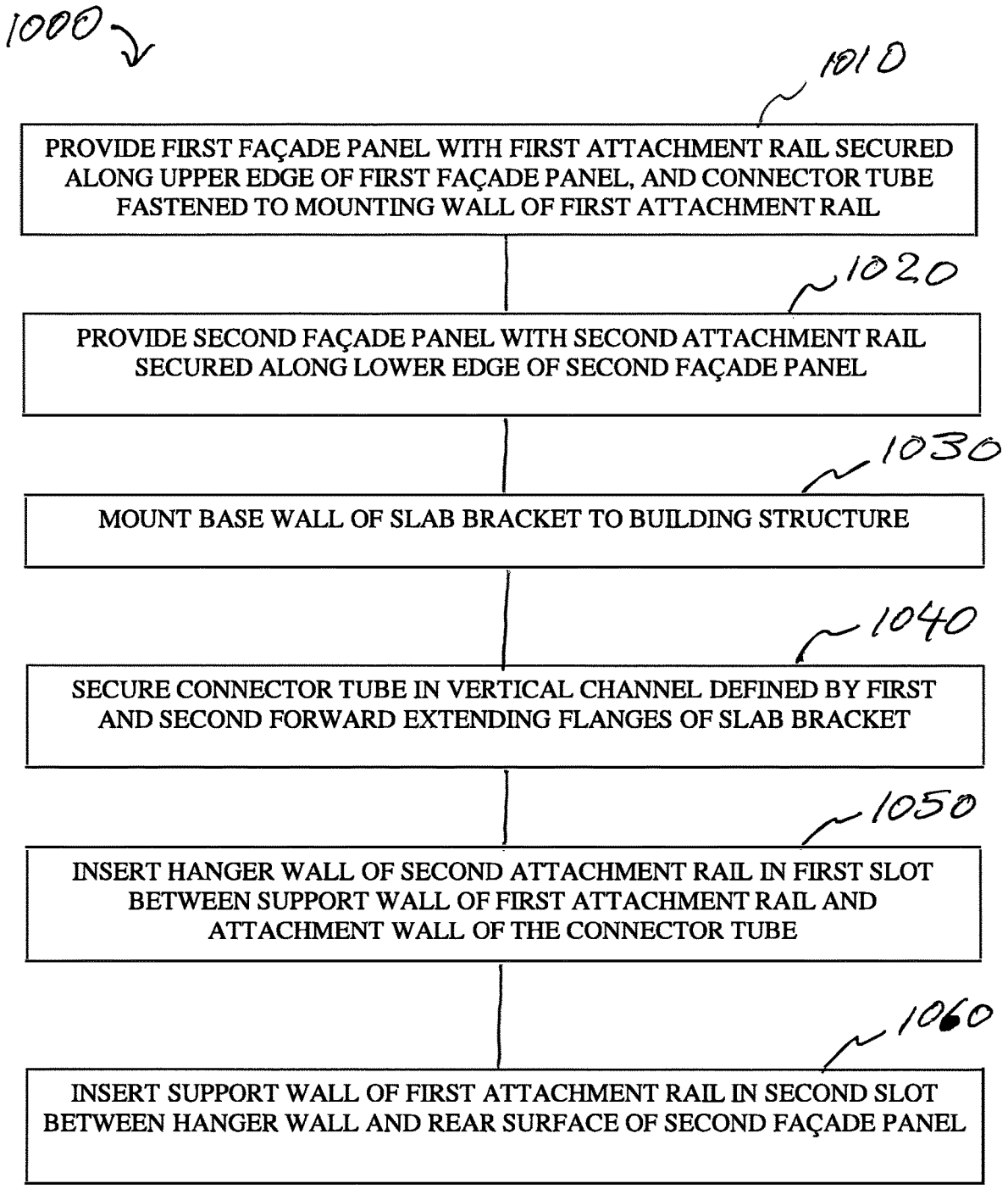
FIG. 14 schematically illustrates a method of installation of a façade panel system, in accordance with an exemplary embodiment of the present disclosure.

FIG. 14 illustrates a flow chart presenting a method 1000 of installation of a wall system, such as the exemplary façade panel system described herein. At step 1010, a first, lower façade panel is provided with a first attachment rail secured along an upper edge of the first façade panel, and a connector tube fastened to a mounting wall of the first attachment rail. At step 1020, a second, upper façade panel is provided with a second attachment rail secured along a lower edge of the second façade panel. At step 1030, a base wall of a slab bracket is mounted to a building structure (e.g., to a vertical edge of a floor slab or a vertically extending building wall substrate). At step 1040, the connector tube is secured in a vertical channel or other such gap defined by first and second forward extending flanges of the slab bracket, for example, using one or more fasteners secured through first and second side walls of the connector tube and through the first and second forward extending flanges. At step 1050, a hanger wall of the second attachment rail is inserted in a first slot between a support wall of the first attachment rail and an attachment wall of the connector tube, and at step 1060 (which may be performed simultaneously with step 1050), the support wall of the first attachment rail is inserted in a second slot between the hanger wall and the rear surface of the second façade panel for interlocking retention of the second attachment rail and second façade panel with the first façade panel.

Although this invention has been described with a certain degree of particularity, it is to be understood that the present disclosure has been made only by way of illustration and that numerous changes in the details of construction and arrangement of parts may be resorted to without departing from the spirit and the scope of the invention.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Parameters identified as "approximate" or "about" a specified value are intended to include both the specified value, values within 5% of the specified value, and values within 10% of the specified value, unless expressly stated otherwise. Further, it is to be understood that the drawings accompanying the present disclosure may, but need not, be to scale, and therefore may be understood as teaching various ratios and proportions evident in the drawings. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

The invention claimed is:

1. A wall cladding system comprising:

a slab bracket including a base wall mountable to a panel mounting location of a building structure and first and second forward extending flanges defining a gap therebetween;

a connector tube secured in the gap by one or more fasteners secured through first and second side walls of the connector tube and through the first and second forward extending flanges;

a first façade panel;

a first attachment rail secured along an upper edge of the first façade panel, including a mounting wall that abuts the connector tube for fastening thereto, and a support wall extending upward from the mounting wall, spaced from the connector tube to define a first slot;

a second façade panel; and a second attachment rail secured along a lower edge of the second façade panel, including a downward extending hanger wall spaced apart from a rear surface of the second façade panel to define a second slot;

wherein the hanger wall of the second attachment rail is received in the first slot, and the support wall of the first attachment rail is received in the second slot, for interlocking retention of the second attachment rail and second façade panel with the first façade panel; and wherein the connector tube provides a discrete panel mounting location and does not extend between multiple panel mounting locations of the building structure.

2. The wall cladding system of claim 1, wherein the connector tube comprises a cuboid section defining the first and second side walls and a connector wall, with the mounting wall of the first attachment rail being fastened to the connector wall.

3. The wall cladding system of claim 2, wherein the connector wall is planar and extends laterally beyond at least one of the first and second side walls to define a flange section.

4. The wall cladding system of claim 2, wherein the connector wall has a thickness at least 50% greater than a thickness of the first and second side walls.

5. The wall cladding system of claim 1, wherein the first attachment rail comprises a Z-shaped rail.

6. The wall cladding system of claim 1, wherein the first attachment rail comprises a first panel fastening wall in abutment with the first façade panel and secured to the first façade panel by one or more fasteners.

7. The wall cladding system of claim 6, wherein the first panel fastening wall is coplanar with the support wall.

8. The wall cladding system of claim 6, wherein the first panel fastening wall is vertically spaced from the support wall by the mounting wall.

9. The wall cladding system of claim 6, wherein the first attachment rail comprises a tube bracing wall in abutment with a lower end of the connector tube and vertically spaced from the mounting wall by the first panel fastening wall.

10. The wall cladding system of claim 9, wherein the first attachment rail comprises a panel bracing wall in abutment with the first façade panel and vertically spaced from the first panel fastening wall by the tube bracing wall.

11. The wall cladding system of claim 1, wherein the second attachment rail comprises a second panel fastening wall in abutment with the second façade panel and secured to the second façade panel by one or more fasteners.

12. The wall cladding system of claim 11, wherein the second panel fastening wall has a vertical length greater than a vertical length of the hanger wall.

13. The wall cladding system of claim 1, wherein the hanger wall of the second attachment rail includes a lip portion sized for snap joint engagement with a rear surface of the mounting wall of the first attachment rail.

14. The wall cladding system of claim 13, wherein the rear surface of the mounting wall comprises a barbed protrusion providing the snap joint engagement with the second attachment rail lip portion.

15. The wall cladding system of claim 1, wherein the connector tube has a vertical length between about 25% greater and about 100% greater than a vertical length of the slab bracket.

16. The wall cladding system of claim 1, wherein the first façade panel comprises a panel body including a rigid framing arrangement having an outer boundary frame portion extending around an outer perimeter of the panel body, wherein the first attachment rail is secured along the upper edge the first façade panel by one or more fasteners installed into the outer boundary frame portion.

17. The wall cladding system of claim 1, wherein the second façade panel comprises a panel body including a rigid framing arrangement having an outer boundary frame portion extending around an outer perimeter of the panel body, wherein the second attachment rail is secured along the lower edge the second façade panel by one or more fasteners installed into the outer boundary frame portion.

18. A method of installing a wall cladding system on a building substrate, the method comprising:

mounting a base wall of a slab bracket to a panel mounting location of a building structure, the slab bracket including first and second forward extending flanges defining a gap therebetween;

providing a first façade panel with a first attachment rail secured along an upper edge the first façade panel, and a connector tube fastened to a mounting wall of the first attachment rail, with a support wall of the first attachment rail extending upward from the mounting wall being spaced from the connector tube to define a first slot;

providing a second façade panel with a second attachment rail secured along a lower edge of the second façade panel, with a downward extending hanger wall of the second attachment rail being spaced apart from a rear surface of the second façade panel to define a second slot;

securing the connector tube in the gap using one or more fasteners secured through first and second side walls of the connector tube and through the first and second forward extending flanges; and inserting the hanger wall of the second attachment rail in the first slot and the support wall of the first attachment rail in the second slot for interlocking retention of the second attachment rail and second façade panel with the first façade panel;

wherein the connector tube provides a discrete panel mounting location and does not extend between multiple panel mounting locations of the building structure.

* * * * *